US010730092B2

(12) United States Patent
Miyagi et al.

(10) Patent No.: US 10,730,092 B2
(45) Date of Patent: Aug. 4, 2020

(54) PRESSED ARTICLE MANUFACTURING METHOD AND PRESS MOLD

(71) Applicant: NIPPON STEEL & SUMITOMO METAL CORPORATION, Tokyo (JP)

(72) Inventors: Takashi Miyagi, Tokyo (JP); Misao Ogawa, Tokyo (JP); Toshimitsu Aso, Tokyo (JP); Yasuharu Tanaka, Tokyo (JP); Keiichi Murakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 734 days.

(21) Appl. No.: 15/321,659

(22) PCT Filed: Jun. 26, 2015

(86) PCT No.: PCT/JP2015/068554
§ 371 (c)(1),
(2) Date: Dec. 22, 2016

(87) PCT Pub. No.: WO2015/199231
PCT Pub. Date: Dec. 30, 2015

(65) Prior Publication Data

US 2017/0151599 A1 Jun. 1, 2017

(30) Foreign Application Priority Data

Jun. 26, 2014 (JP) ..... 2014-131902

(51) Int. Cl.
*B21D 22/20* (2006.01)
*B21D 22/26* (2006.01)
*B21D 24/00* (2006.01)

(52) U.S. Cl.
CPC ..... *B21D 22/20* (2013.01); *B21D 22/26* (2013.01); *B21D 24/00* (2013.01)

(58) Field of Classification Search
CPC ..... B21D 22/02; B21D 22/26; B21D 22/30; B21D 24/00; B21D 5/01; B21D 5/06; B21D 22/20; B21D 47/01
See application file for complete search history.

(56) References Cited

U.S. PATENT DOCUMENTS 8,129,035 B2 * 3/2012 Kimura ..... C21D 6/005 29/897
9,248,487 B2 * 2/2016 Daimaru ..... B21D 22/26
(Continued)

FOREIGN PATENT DOCUMENTS

CN 1704184 A 12/2005
DE 4411337 A1 * 10/1995 ..... B21D 22/26
(Continued)

OTHER PUBLICATIONS

Japanese Office Action for corresponding Japanese Application No. 2016-529682, dated May 8, 2018, with an English translation.
(Continued)

*Primary Examiner* — Pradeep C Battula
(74) *Attorney, Agent, or Firm* — Birch, Stewart, Kolasch & Birch, LLP

(57) ABSTRACT

A pressed article manufacturing method employing a press mold equipped with a punch and a die to manufacture a pressed article including a first wall, a second wall extending out from an end portion on at least one length direction side of the first wall toward a back face side of the first wall, and a third wall extending out from a leading end portion of the second wall toward a front face side of the second wall. The manufacturing method includes using the punch and the die to apply pressure to and grip a portion on a base end side of the second wall in a first warp shape in which the base end side portion is warped so as to be convex on a back face side
(Continued)

of the second wall as viewed in lateral cross-section in a state prior to demolding from the press mold.

5 Claims, 15 Drawing Sheets

(56) References Cited

U.S. PATENT DOCUMENTS

| | | | | |
|---|---|---|---|---|
| 9,718,113 | B2 * | 8/2017 | Nakata | B21D 22/26 |
| 10,022,763 | B2 * | 7/2018 | Tanaka | B21D 22/26 |
| 2003/0061852 | A1 | 4/2003 | Yamano et al. | |
| 2005/0262917 | A1 | 12/2005 | Osumi et al. | |
| 2006/0125140 | A1 * | 6/2006 | Saitou | B21D 22/20 264/155 |
| 2010/0005845 | A1 * | 1/2010 | Yoshida | G06F 17/5018 72/31.01 |
| 2015/0224563 | A1 | 8/2015 | Aso et al. | |
| 2018/0126433 | A1 * | 5/2018 | Ogawa | B21D 22/26 |
| 2018/0264534 | A1 * | 9/2018 | Aso | B21D 22/20 |

FOREIGN PATENT DOCUMENTS

| | | | |
|---|---|---|---|
| EP | 1602418 | A2 | 12/2005 |
| JP | 2004-168141 | A | 6/2004 |
| JP | 2004-337980 | A | 12/2004 |
| JP | 2006-263788 | A | 10/2006 |
| JP | 2007-111725 | A | 5/2007 |
| JP | 4984414 | B2 | 7/2012 |
| KR | 10-0645150 | B1 | 11/2006 |
| WO | 2014/042067 | A1 | 12/2005 |
| WO | 2010/007521 | A2 | 1/2010 |

OTHER PUBLICATIONS

International Search Report issued in PCT/JP2015/068554, dated Sep. 15, 2015.

Office Action for Taiwanese Application No. 104120787, dated Aug. 8, 2016.

Written Opinion of the International Searching Authority issued in PCT/JP2015/068554 (PCT/ISA/237), dated Sep. 15, 2015.

Extended European Search Report for Application No. 15811816.6, dated Feb. 9, 2018.

Korean Notice of Submission of Opinion for counterpart Korean Application No. 10-2016-7036113, dated Jan. 15, 2019, with English translation.

* cited by examiner

FIG.7

| | VERTICAL WALL ANGLE | VERTICAL WALL SHAPE | |
|---|---|---|---|
| | | INWARDLY CONVEX R | OUTWARDLY CONVEX R |
| COMPARATIVE EXAMPLE 1 | 12° | STRAIGHT LINE | STRAIGHT LINE |
| COMPARATIVE EXAMPLE 2 | 15° | STRAIGHT LINE | STRAIGHT LINE |
| COMPARATIVE EXAMPLE 3 | 20° | STRAIGHT LINE | STRAIGHT LINE |
| EXAMPLE 1-(1) | 12° | R150 | R150 |
| EXAMPLE 1-(2) | 12° | R150 | R120 |
| EXAMPLE 1-(3) | 15° | R120 | R120 |
| EXAMPLE 1-(4) | 15° | R120 | R100 |
| EXAMPLE 1-(5) | 20° | R120 | R120 |
| EXAMPLE 1-(6) | 20° | R120 | R100 |
| EXAMPLE 1-(7) | 12° | R30 TO R150 | R10 TO R160 |
| EXAMPLE 1-(8) | 12° | R150 TO R550 | R100 TO R500 |
| EXAMPLE 1-(9) | 12° | R130 TO R700 | R120 TO R800 |
| EXAMPLE 2-(1) | 12° | R150 | STRAIGHT LINE |
| EXAMPLE 2-(2) | 15° | R150 | STRAIGHT LINE |
| EXAMPLE 2-(3) | 20° | R150 | STRAIGHT LINE |
| EXAMPLE 2-(4) | 15° | R120 | STRAIGHT LINE |

PRESSED ARTICLE MANUFACTURING METHOD AND PRESS MOLD

TECHNICAL FIELD

The present invention relates to a manufacturing method for a pressed article, and a press mold.

BACKGROUND ART

As is widely known, automotive bodies include what are known as monocoque structures. Namely, automotive bodies are configured by body shells in which reinforcement framework members are joined to relevant portions such as portions on which stress acts, and portions that support heavy objects, in a box shaped structural body in which multiple molded panels are superimposed on each other and joined together.

FIG. 12A to FIG. 12D are explanatory diagrams respectively illustrating framework members 1 to 4, to be disposed at relevant portions of a body shell. As illustrated in FIG. 12A to FIG. 12D, the framework members 1 to 4 are generally manufactured as hat shaped members with hat shaped lateral cross-section profiles by pressing blanks, these being stock materials, using a punch and a die. More specifically, the framework members 1 to 4 are each configured including a top plate 5 (first wall), two ridge lines 6*a*, 6*b* formed along two edges of the top plate 5, two vertical walls 7*a*, 7*b* (second walls) respectively linked to the two ridge lines 6*a*, 6*b*, two bend lines 8*a*, 8*b* respectively linked to the two vertical walls 7*a*, 7*b*, and two flanges 9*a*, 9*b* (third walls) respectively linked to the two bend lines 8*a*, 8*b*. Note that FIG. 12D illustrates a case in which the framework member 4 has been spot welded to a closing plate P through the flanges 9*a*, 9*b*.

As part of vehicle body weight reduction in order to both reduce $CO_2$ emissions further, and also improve crash safety, there has been a recent trend toward making the framework members 1 to 4 even stronger and thinner. Accordingly, the framework members 1 to 4 are, for example, configured from sheet steel stock material with a tensile strength of 590 MPa or greater, 780 MPa or greater, and in some cases, 980 MPa or greater.

FIG. 13A to FIG. 13C are explanatory diagrams illustrating the occurrence of spring back (also referred to as "vertical wall warping" in the present specification) arising in the vertical walls 7*a*, 7*b* when demolding the framework members 1 to 4 after pressing. Specifically, FIG. 13A is a cross-section illustrating how the framework members 1 to 4 are pressed. FIG. 13B is a contour diagram illustrating moment distribution in the vertical walls 7*a*, 7*b* of the framework members 1 to 4 after pressing. FIG. 13C is a cross-section illustrating vertical wall warping in the framework members 1 to 4.

As illustrated in FIG. 13A, when pressing the framework members 1 to 4, portions B1, B2 of a blank B that are formed into the vertical walls 7*a*, 7*b* are subjected to bending, and bend-back, deformation by a punch 10 and a die 11 during the pressing process. Accordingly, as illustrated in FIG. 13B, accompanying the increased strength of the framework members 1 to 4, moments due to stress differences in the sheet thickness direction of the blank B (stress differences between stress at an outer side face (front face) and an inner side face (back face)) arise in the formed vertical walls 7*a*, 7*b*. More specifically, after forming, compressive stress acts on an outer side face (front face), and tensile stress acts on an inner side face (back face) at base end side portions of the vertical walls 7*a*, 7*b*. Accordingly, a moment (referred to below as "inward warp moment") that would cause the base end side portions of the vertical walls 7*a*, 7*b* to warp so as to become convex on the front face side of the vertical walls 7*a*, 7*b* (curl around toward the inside of the framework members 1 to 4) arises in the base end side portions of the vertical walls 7*a*, 7*b* due to the difference between the stress in the outer side faces and the stress in the inner side faces of the vertical walls 7*a*, 7*b*.

By contrast, after forming, tensile stress acts on the outer side face (front face), and compressive stress acts on the inner side face (back face) at leading end side portions of the vertical walls 7*a*, 7*b*. Accordingly, a moment (referred to below as "outward warp moment") that would cause the leading end side portions of the vertical walls 7*a*, 7*b* to warp so as to become convex on the back face side of the vertical walls 7*a*, 7*b* (curl around toward the outside of the framework members 1 to 4) arises in the leading end side portions of the vertical walls 7*a*, 7*b* due to the difference between the stress in the outer side faces and the stress in the inner side faces of the vertical walls 7*a*, 7*b*. Moreover, as illustrated in FIG. 13C, when the pressure applied to the framework members 1 to 4 by the punch 10 and the die 11 is removed during demolding following pressing, vertical wall warping is liable to occur in which, due to elastic deformation recovery, the two vertical walls 7*a*, 7*b* depart from the shape they take on when applied with pressure (a manufactured article shape), and return to an opened-out shape (a shape in which the two flanges 9*a*, 9*b* have moved apart from each other).

As a countermeasure thereto, as illustrated in FIG. 14A to FIG. 14C, technology is known in which vertical wall warping is suppressed by providing beads 12, steps 13, or the like to parts of the vertical walls 7*a*, 7*b*. Moreover, for example, Japanese Patent No. 4984414 (Patent Document 1) describes technology in which vertical walls are formed with a continuous undulating shape in order to suppress spring back.

Moreover, Japanese Patent Application Laid-Open (JP-A) No. 2007-111725 (Patent Document 2) describes technology to reduce spring back in a pressed article that is pressed plural times. For example, as illustrated in FIG. 15, technology is described in which a pressed article that been pressed a first time (see the left side of FIG. 15) is pressed a second time using a punch with a larger width dimension (see the right side of FIG. 15) in order to reduce spring back in the pressed article.

SUMMARY OF INVENTION

Technical Problem

However, the technology described in the related technology illustrated in FIG. 14A to FIG. 14C, and in the technology in Patent Document 1, do not suppress or eliminate the actual moments arising in the vertical walls. In particular, the inward warp moment arising in the base end portions of the vertical walls is not suppressed or eliminated. Moreover, in the related technology illustrated in FIG. 14A to FIG. 14C, it is necessary to form the beads 12 or the steps 13 in the vertical walls 7*a*, 7*b*, and in the technology described in Patent Document 1, it is necessary to form the vertical walls in undulating shapes. Accordingly, such technology cannot be applied to the framework members 1 to 4 in cases in which the design does not permit the formation of the beads 12 or the steps 13, or formation of undulating shapes in the vertical walls.

Likewise, the technology described in Patent Document 2 does not suppress or eliminate the actual moments arising in the vertical walls 7*a*, 7*b*. In particular, the inward warp moment arising in the base end portions of the vertical walls 7*a*, 7*b* is not suppressed or eliminated. As described above, such technology therefore leaves room for improvement with regard to suppressing or eliminating the inward warp moment arising in the base end portions of the vertical walls.

In consideration of the above circumstances, the present disclosure relates to obtaining a pressed article manufacturing method and a press mold capable of suppressing the occurrence of wall warping in a base end portion of a second wall in a pressed article having a high strength of, for example, 590 MPa or greater, 780 MPa or greater, or in some cases 980 MPa or greater.

Solution to Problem

A pressed article manufacturing method of the present disclosure employs a press mold equipped with a punch and a die to manufacture a pressed article including a first wall, a second wall extending out from an end portion on at least one length direction side of the first wall toward a back face side of the first wall, and a third wall extending out from a leading end portion of the second wall toward a front face side of the second wall. The manufacturing method includes using the punch and the die to apply pressure to and grip a portion on a base end side of the second wall in a first warp shape in which the base end side portion is warped so as to be convex on a back face side of the second wall as viewed in lateral cross-section in a state prior to demolding from the press mold.

In the pressed article manufacturing method addressing the issue described above, the pressed article formed using the manufacturing method includes the first wall, the second wall extending out from an end portion on at least one length direction side of the first wall toward a back face side of the first wall, and the third wall extending out from the leading end portion of the second wall toward the front face side of the second wall. Namely, the lateral cross-section profile of the pressed article is what is referred to as hat shaped or Z-shaped (crank shaped). Note that when manufacturing a pressed article with a lateral cross-section profile such as that described above using a punch and a die, after forming, compressive stress acts on the front face (outer side face), and tensile stress acts on the back face (inner side face) of the base end side portion (portion on the first wall side) of the second wall. Accordingly, a moment that would cause the base end side portions of the second wall to warp so as to become convex on the front face (outer side face) side of the second wall (warp so as to curl around toward the inside of the pressed article) (this moment is referred to below as "inward warp moment") arises in the base end side portion of the second wall due to the difference in stress in the sheet thickness direction of the base end side portion of the second wall (the difference between the stress in the front face (outer side face) and the stress in the back face (inner side face) of the base end side portion of the second wall).

The punch and the die are employed to apply pressure to and grip the base end side portion of the second wall in the first warp shape, in which the base end side portion is warped so as to be convex on the back face side of the second wall as viewed in lateral cross-section in a state prior to demolding from the press mold. Accordingly, in the pressed article prior to demolding from the press mold, the base end side portion of the second wall, which is attempting to warp so as to become convex on the front face side of the second wall (the outside of the pressed article) due to the inward warp moment, is corrected by the first warp shape that is warped so as to be convex on the back face side of the second wall (the inside of the pressed article). Accordingly, the inward warp moment arising in the second wall is cancelled out. As a result, when the pressure applied by the punch and the die is removed during demolding from the press mold, strain difference in the sheet thickness direction of the base end side portion of the second wall is reduced, thereby enabling the occurrence of wall warping in the base end portion of the second wall to be suppressed.

A press mold of the present disclosure is a press mold for manufacturing a pressed article including a first wall, a second wall extending out from an end portion on at least one length direction side of the first wall toward a back face side of the first wall, and a third wall extending out from a leading end portion of the second wall toward a front face side of the second wall. The press mold includes a punch and a die that form the pressed article by moving relative to each other in a direction approaching each other. A first pressure application section is formed at the punch and the die, the first pressure application section applying pressure to and gripping a portion on a base end side of the second wall in a first warp shape in which the base end side portion is warped so as to be convex on a back face side of the second wall as viewed in lateral cross-section in a state prior to demolding from the punch and the die.

In the press mold addressing the above issue, the first pressure application section is formed at the punch and the die, the first pressure application section applying pressure to and gripping the base end side portion of the second wall in the first warp shape in which the base end side portion is warped so as to be convex on a back face side of the second wall as viewed in lateral cross-section in a state prior to demolding from the punch and the die. Accordingly, similarly to as described above, in the pressed article prior to demolding from the press mold, the base end side portion of the second wall, which is attempting to warp so as to become convex on the front face side of the second wall (the outside of the pressed article) due to the inward warp moment, is corrected by the first warp shape that is warped so as to be convex on the back face side of the second wall (the inside of the pressed article). Accordingly, the inward warp moment arising in the second wall is cancelled out. As a result, when the pressure applied by the punch and the die is removed during demolding from the press mold, strain difference in the sheet thickness direction of the base end side portion of the second wall is reduced, thereby enabling the occurrence of wall warping in the base end portion of the second wall to be suppressed.

Advantageous Effects of Invention

The pressed article manufacturing method and the press mold of the present disclosure enable the occurrence of wall warping in the base end portion of the second wall to be suppressed.

BRIEF DESCRIPTION OF DRAWINGS

FIG. 7 is a table evaluating pressed articles manufactured in Example 1 and Example 2 and pressed articles of comparative examples.

DESCRIPTION OF EMBODIMENTS

First, explanation follows regarding a pressed article 26 formed using a pressed article manufacturing method according to an exemplary embodiment. Explanation will then be given regarding a press mold for forming the pressed article 26. Note that the pressed article 26 is configured by a molded article in a state in which the press mold has been opened, described later.

Pressed Article 26

Figure 3:
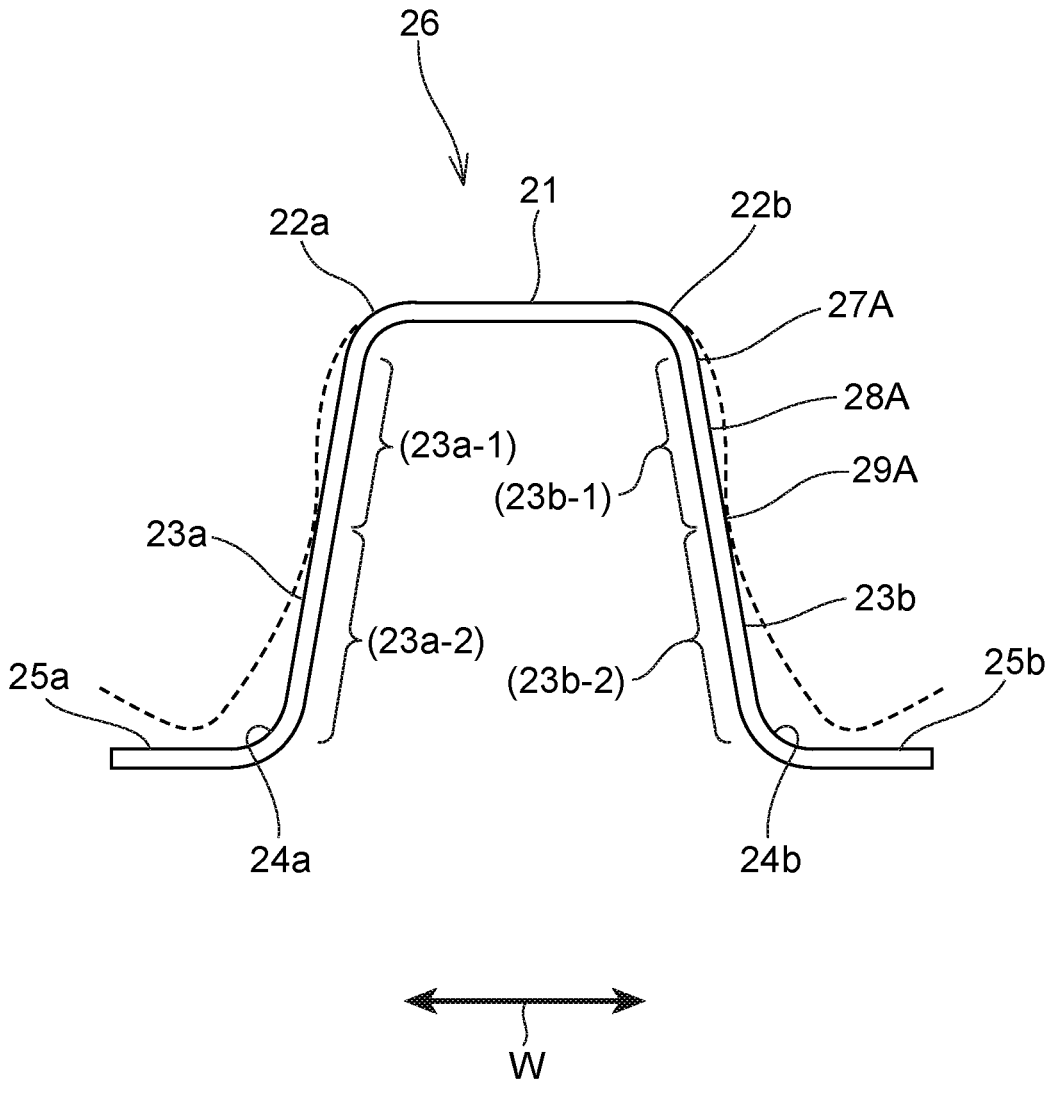
FIG. 3 is an explanatory diagram to explain the shape of a pressed article formed using a press mold according to the present exemplary embodiment.

As illustrated in FIG. 3, the pressed article 26 is formed in a shape having what is referred to as a hat shaped lateral cross-section profile. Namely, the pressed article 26 is configured including a top plate 21, serving as a "first wall" with its length direction along a width direction of the pressed article 26 (along the arrow W direction in FIG. 3), a pair of ridge lines 22*a*, 22*b* respectively linked to both length direction end portions of the top plate 21, a pair of vertical walls 23*a*, 23*b*, serving as "second walls" that are respectively linked to the pair of ridge lines 22*a*, 22*b* and that extend out from the respective ridge lines 22*a*, 22*b* toward one sheet thickness direction side (a back face side) of the top plate 21, a pair of bend lines 24*a*, 24*b* respectively linked to leading end portions (lower end portions) of the pair of vertical walls 23*a*, 23*b*, and a pair of flanges 25*a*, 25*b*, serving as "third walls" respectively linked to the pair of bend lines 24*a*, 24*b* and respectively extending out from the bend lines 24*a*, 24*b* toward both length direction sides of the top plate 21 (front face sides of the vertical walls 23*a*, 23*b*). Note that in the following explanation, a front face side of the pressed article 26 is referred to as the outside of the pressed article 26, and a back face side of the pressed article 26 is referred to as the inside of the pressed article 26.

The pair of ridge lines 22*a*, 22*b* are curved in substantially circular arc shapes that are convex toward the outside of the pressed article 26. Namely, the two ridge lines 22*a*, 22*b* configure corner portions that are convex toward the outside of the pressed article 26. Moreover, the pair of bend lines 24*a*, 24*b* are curved in substantially circular arc shapes that are convex toward the inside of the pressed article 26. The vertical walls 23*a*, 23*b* are inclined toward both length direction sides (the outside) of the top plate 21 on progression toward their leading end sides when the pressed article 26 is viewed in lateral cross-section. In other words, the two vertical walls 23*a*, 23*b* are inclined in directions away from each other on progression toward their leading end sides. Accordingly, in the pressed article 26, leading end portions of the vertical walls 23*a*, 23*b* are formed spreading apart toward the length direction outer sides of the top plate 21, and angles formed between the top plate 21 and the vertical walls 23*a*, 23*b* are set as obtuse angles.

Note that the pressed article 26 of the present disclosure is not limited to the above shape. For example, the pressed article 26 may similarly be applied with shapes having a lateral cross-section profile (specifically, a Z-shape (crank shape)). Namely, in such cases, the pressed article 26 is configured including the top plate 21, a single ridge line 22*a* linked to one length direction side end portion of the top plate 21, a single vertical wall 23*a* linked to the ridge line 22*a* and extending out from the ridge line 22*a* toward one sheet thickness direction side of the top plate 21, a single bend line 24*a* linked to the vertical wall 23*a*, and a single flange 25*a* that is linked to the bend line 24*a* and extends from the bend line 24*a* toward one length direction side of the top plate 21.

The pressed article 26 with the hat shaped lateral cross-section profile described above has a left-right symmetrical shape about a line at the width direction center of the pressed article 26. However, the pressed article 26 may have a left-right asymmetrical shape. Moreover, in the pressed article 26 with the hat shaped lateral cross-section profile described above, as an example, the angles formed between the top plate 21 and the vertical walls 23*a*, 23*b* are set as obtuse angles. However, in the pressed article described later, in cases in which the pressed article 26 is configured using a cam bending method, for example, the angles formed between the top plate 21 and the vertical walls 23*a*, 23*b* may be set as substantially right angles, or acute angles.

The pressed article 26 of the present disclosure is obtained by cold or warm pressing (first pressing) a blank or a blank that has been subjected to additional processing using the pressed article manufacturing method described later. The pressed article 26 of the present disclosure may also be obtained by restriking (second pressing) as necessary following the first pressing mentioned above.

The tensile strength of the blank, this being a forming stock material for the pressed article 26, or of the pressed article 26, is 590 MPa or greater, is preferably 780 MPa or greater and is even more preferably 980 MPa or greater. This is since at tensile strengths of below 590 MPa, vertical wall warping, this being the issue addressed by the present invention, is unlikely to occur, with vertical wall warping becoming more likely to occur the higher the tensile strength. From this perspective, there is no need to specify an upper limit to the tensile strength of the blank or the pressed article 26; however, when considering the upper limit of practical press loads, the tensile strength is preferably 2000 MPa or lower.

Note that in the following explanation, for convenience, the pressed article in a state prior to demolding from the press mold, described later, is allocated the reference numeral 20, and a distinction is made between the pressed article in the state prior to demolding and the pressed article in the state after demolding from the press mold.

Press Mold

Figure 1B:
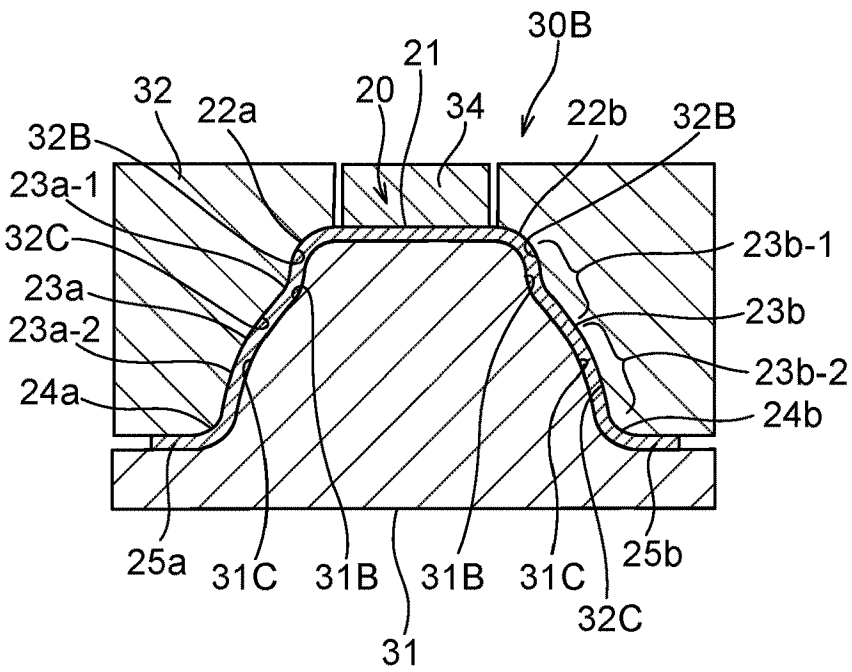
FIG. 1B is a cross-section illustrating configuration of another example of a press mold according to an exemplary embodiment.
Figure 1A:
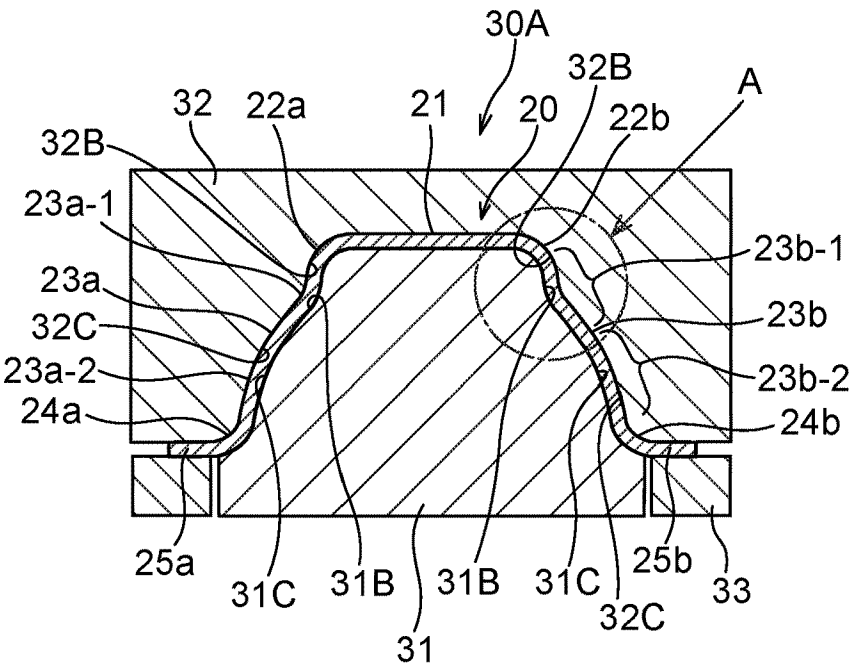
FIG. 1A is a cross-section illustrating configuration of an example of a press mold according to an exemplary embodiment.

FIG. 1A illustrates a press mold 30A in a case in which the pressed article 26 is manufactured by performing drawing on a blank during the first pressing, described later. FIG. 1B illustrates a press mold 30B in a case in which the pressed article 26 is manufactured by performing bending on a blank during the first pressing, described later. Note that in FIG. 1A and FIG. 1B, the width direction of the pressed article 20 corresponds to the width direction of the press molds 30A, 30B.

As illustrated in FIG. 1A, the press mold 30A employed when the blank is drawn during the first pressing is configured including a punch 31, a die 32, and a pair of blank holders 33. Specifically, the die 32 configures an upper section of the press mold 30A, and is formed with a recessed shape opening toward the lower side as viewed in lateral cross-section. The punch 31 is disposed at the lower side of the recess of the die 32, and is formed in a protruding shape projecting toward the upper side. The punch 31 is configured capable of relative movement toward the upper side with respect to the die 32. The pair of blank holders 33 are disposed on both width direction sides of the punch 31, and are configured such that portions of the blank that will be formed into the flanges 25*a*, 25*b* are gripped by the blank holders 33 and the die 32.

As illustrated in FIG. 1B, the press mold 30B employed when the blank is bent during the first pressing is configured including a punch 31, a pair of dies 32, and a die pad 34. Specifically, the pair of dies 32 configure an upper section of the press mold 30B, and form an overall recessed shape opening toward the lower side. The punch 31 is disposed at the lower side of the dies 32, and is formed in a protruding shape projecting toward the upper side. The dies 32 are configured capable of relative movement toward the lower side with respect to the punch 31. The die pad 34 is disposed between the pair of dies 32, and is configured such that a portion of the blank that will be formed into the top plate 21 is gripped by the die pad 34 and the punch 31.

As illustrated in FIG. 1A and FIG. 1B, the punch 31 has an outer surface profile matching respective parts of the top plate 21, the ridge lines 22*a*, 22*b*, and the vertical walls 23*a*, 23*b* of the pressed article 20. The dies 32 have inner surface profiles matching outer surface profiles of respective parts of the top plate 21, the ridge lines 22*a*, 22*b*, and the vertical walls 23*a*, 23*b* of the pressed article 20.

Figure 5A:
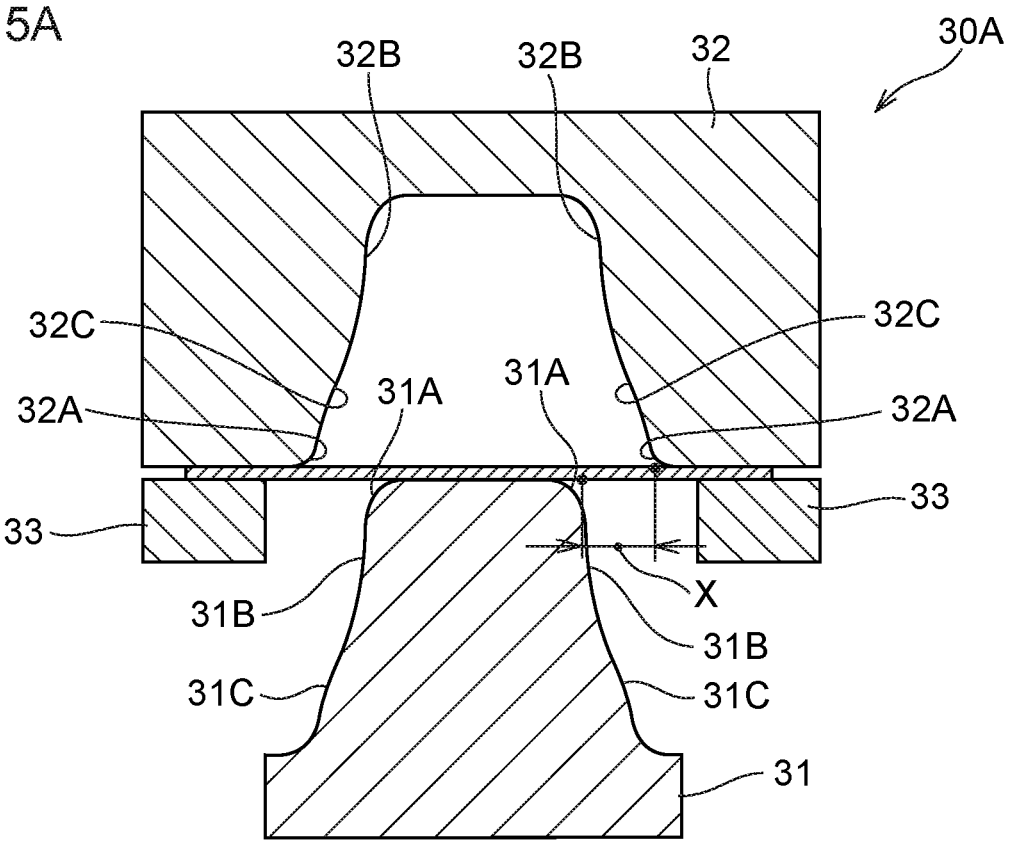
FIG. 5A is a cross-section illustrating a state immediately prior to forming a blank with the press mold illustrated in FIG. 1A.

In the pressed article 26, since the angles formed between the top plate 21 and the vertical walls 23*a*, 23*b* are set as obtuse angles, as illustrated in FIG. 5A, corner portions 32A of the die 32 are disposed further apart from each other, toward width direction outer sides of the press mold 30A (30B), than corner portions 31A of the punch 31. A distance in the width direction of the press mold 30A (30B) between one of the corner portions 31A of the punch 31 (an intersection point between a forming face that forms the top plate 21 and a forming face that forms the vertical wall 23*a* or 23*b* as viewed in lateral cross-section) and the corresponding corner portion 32A of the die 32 (an intersection point between a forming face that forms the vertical wall 23*a* or 23*b* and a forming face that forms the flange 25*a* or 25*b* as viewed in lateral cross-section) is denoted distance X.

Note that in the press mold 30A (30B) of the present disclosure, portions of the punch 31 and the die 32 that form the vertical walls 23*a*, 23*b* are formed with undulating pressure application sections. This thereby reduces strain difference in the vertical walls 23*a*, 23*b* of the pressed article 26 in the sheet thickness direction of the vertical walls 23*a*, 23*b* after the pressed article 20 has been formed by the punch 31 and the die 32 and demolded from the press mold 30A (30B). This will be described in detail below.

Portions of the punch 31 that form base end side portions of the vertical walls 23*a*, 23*b* (portions toward the side of the top plate 21 and ridge lines 22*a*, 22*b*) are formed with punch side concave curved face portions 31B, serving as "first pressure application sections". The punch side concave curved face portions 31B are formed in concave curved face shapes indented toward the width direction inner side of the punch 31 (the inside of the pressed article 20).

Portions of the punch 31 that form leading end side portions of the vertical walls 23*a*, 23*b* (portions toward the side of the bend lines 24*a*, 24*b* and the flanges 25*a*, 25*b*) are formed with punch side convex curved face portions 31C, serving as "second pressure application sections". The punch side convex curved face portions 31C are formed in convex curved face shapes that protrude toward the width direction outer side of the punch 31 (the outside of the pressed article 20).

Portions of the die(s) 32 that form base end side portions of the vertical walls 23*a*, 23*b* are formed with die side convex curved face portions 32B, serving as "first pressure application sections". The die side convex curved face portions 32B are formed in convex curved face shapes that protrude toward the width direction inner side of the die 32 (the inside of the pressed article 20). Accordingly, when forming the vertical walls 23*a*, 23*b* with the punch 31 and the die 32, base end side portions of the vertical walls 23*a*, 23*b* are applied with pressure and gripped by the punch side concave curved face portions 31B and the die side convex curved face portions 32B (see FIG. 1A).

Portions of the die 32 that form leading end side portions of the vertical walls 23*a*, 23*b* are formed with die side concave curved face portions 32C, serving as a "second pressure application section". The die side concave curved face portions 32C are formed in concave curved face shapes indented toward the width direction outer sides of the die 32 (the outside of the pressed article 20). Accordingly, when forming the vertical walls 23*a*, 23*b* with the punch 31 and the die 32, leading end side portions of the vertical walls 23*a*, 23*b* are applied with pressure and gripped by the punch side convex curved face portions 31C and the die side concave curved face portions 32C (see FIG. 1A).

Accordingly, as illustrated in FIG. 1A and FIG. 1B, in the pressed article 20, after completion of pressing using the punch 31 and the die 32, and before demolding from the press mold 30A (30B), the base end side portions of the pair of vertical walls 23*a*, 23*b* are applied with pressure and gripped by the punch 31 and the die 32 in first warp shapes 23*a*-1, 23*b*-1 that are convex toward the inside of the pressed article 26 (the back face side of the vertical walls 23*a*, 23*b*). Moreover, in the pressed article 20, the leading end side portions of the pair of vertical walls 23*a*, 23*b* are applied with pressure and gripped by the punch 31 and the die 32 in second warp shapes 23*a*-2, 23*b*-2 that are convex toward the outside of the pressed article 26 (the front face side of the vertical walls 23*a*, 23*b*). Namely, in this state of the pressed article 20, the two vertical walls 23*a*, 23*b* are applied with pressure and gripped by the punch 31 and the die 32 so as to form an S-shaped lateral cross-section profile. Accordingly, as will be described in detail later, configuration is made so as to correct warp of the vertical walls 23*a*, 23*b* across the overall extension direction of the vertical walls 23*a*, 23*b*. Note that depending on the specifications of the pressed article and the like, the press mold 30A (30B) of the present disclosure may, for example, be configured without providing the punch side convex curved face portions 31C and the die side concave curved face portions 32C. Namely, the punch side convex curved face portions 31C and the die side concave curved face portions 32C may be formed with flat plane shapes.

The first warp shapes 23*a*-1, 23*b*-1 and the second warp shapes 23*a*-2, 23*b*-2 of the pressed article 20 are configured as shapes having uniform curvature. Specifically, the punch side concave curved face portions 31B, the punch side convex curved face portions 31C, the die side convex curved face portions 32B, and the die side concave curved face portions 32C are formed such that the radii of curvature of both the first warp shapes 23*a*-1, 23*b*-1 and the second warp shapes 23*a*-2, 23*b*-2 are from 10 mm to 800 mm. If the radius of curvature is below 10 mm, bending marks remain in the vertical walls 23*a*, 23*b* of the pressed article 26, and bending cracks may occur in cases in which the tensile strength of the blank is 590 MPa or greater. If the radius of curvature is greater than 800 mm, the effect of correcting strain difference in the sheet thickness direction of the vertical walls 23*a*, 23*b* of the pressed article 26 becomes small, and it may not be possible to reduce spring back (wall warp) of the vertical walls 23*a*, 23*b*. Note that the first warp shapes 23*a*-1, 23*b*-1 and the second warp shapes 23*a*-2, 23*b*-2 may be shapes having plural curvatures, such as elliptical arc shapes.

The respective sums of cross-section peripheral lengths of the first warp shapes 23*a*-1, 23*b*-1 and cross-section peripheral lengths of the second warp shapes 23*a*-2, 23*b*-2 are set to not less than 50% of the cross-section peripheral lengths of the vertical walls 23*a*, 23*b* of the pressed article 26. If the sum is less than 50% of the cross-section peripheral length of the respective vertical walls 23*a*, 23*b*, the effect of correcting strain difference in the sheet thickness direction of the vertical walls 23*a*, 23*b* becomes small, and it may not be possible to reduce spring back (wall warping) in the vertical walls 23*a*, 23*b*.

As illustrated in FIG. 1A and FIG. 1B, the portions of the punch 31 and the die 32 that form the vertical walls 23*a*, 23*b* may be configured such that the first warp shapes 23*a*-1, 23*b*-1 and the second warp shapes 23*a*-2, 23*b*-2 are formed continuously to one another. Alternatively, the portions of the punch 31 and the die 32 that form the vertical walls 23*a*, 23*b* may be configured such that, for example, respective straight line shaped portions or curved line shaped portions are interposed between the first warp shapes 23*a*-1, 23*b*-1 and the second warp shapes 23*a*-2, 23*b*-2.

The cross-section peripheral length of each of the first warp shapes 23*a*-1, 23*b*-1 is set so as to be not less than the distance X between the respective corner portions 31A of the punch 31 and the respective corner portions 32A of the die 32 in the width direction of the press mold 30A (30B), and is set equal to or less than ½ the cross-section peripheral length of the respective vertical walls 23*a*, 23*b*. Namely, when forming the vertical walls 23*a*, 23*b*, the vertical walls 23*a*, 23*b* are formed by bending the blank about origins at the portions pressed by the corner portions 31A of the punch 31. Accordingly, the cross-section peripheral length of the respective first warp shapes 23*a*-1, 23*b*-1 is preferably set to not less than the distance X. Moreover, when forming the vertical walls 23*a*, 23*b*, the blank is pulled in at portions that will form the vertical walls 23*a*, 23*b*. Accordingly, in consideration of pulling in the blank, the cross-section peripheral length of the first warp shapes 23*a*-1, 23*b*-1 is set to a length equal to or less than ½ that of the respective vertical walls 23*a*, 23*b*.

Figure 2:
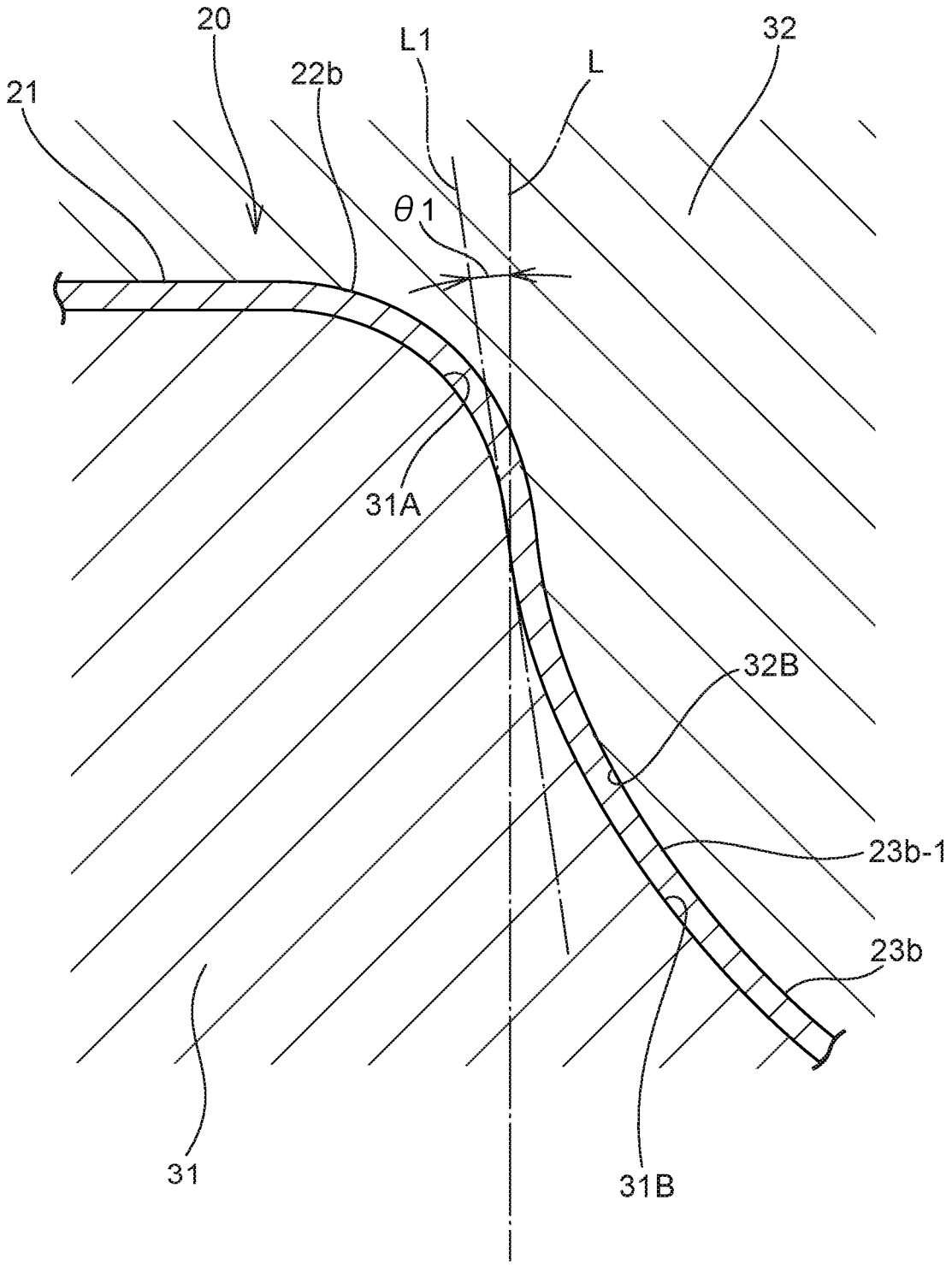
FIG. 2 is an enlarged cross-section (in which region A in FIG. 1A is enlarged) illustrating the periphery of a punch side concave curved face portion and a die side convex curved face portion of the press mold illustrated in FIG. 1A.

The placement of the first warp shapes 23*a*-1, 23*b*-1 is set as follows. Namely, as illustrated in FIG. 2, first, a line passing through an upper edge of the first warp shape 23*b*-1 (23*a*-1) (an intersection point with the ridge line 22*b* (22*a*)), and running along the up-down direction of the pressed article 26 (the sheet thickness direction of the top plate 21), is denoted as a reference line L. Then, a line passing through an upper edge of the first warp shape 23*b*-1 (23*a*-1) and tangential to the first warp shape 23*b*-1 (23*a*-1) is denoted as tangent line L1. The tangent line L1 is inclined toward the width direction outer side of the pressed article 20 on progression toward the leading end side of the vertical wall 23*b* (23*a*). In other words, if an inclination angle of the tangent line L1 with respect to the reference line L is denoted by θ1, the inclination angle is set such that θ1 does not become a negative value. Namely, if the inclination angle θ were to become a negative value, the tangent line L1 would be inclined toward the width direction inner side of the pressed article 20 on progression toward the leading end side of the vertical wall 23*b* (23*a*). Accordingly, in such cases, when forming the pressed article 20 using the punch 31 and the die 32, parts of the punch side concave curved face portions 31B and the die side convex curved face portions 32B would adopt a state overlapping (superimposed on) the first warp shape 23*b*-1 (23*a*-1) in the up-down direction. Accordingly, when opening the punch 31 and the die 32 in the up-down direction, the first warp shape 23*b*-1 (23*a*-1) would be wrenched by the punch side concave curved face portions 31B and the die side convex curved face portions 32B, potentially damaging the pressed article 26. Accordingly, in order to prevent damage to the pressed article 26, the inclination angle is set such that θ1 does not become a negative value.

Prior to forming the vertical walls 23*a*, 23*b* into the S-shaped lateral cross-section profile, portions of the blank intended to form the vertical walls do not have to have a straight line shaped lateral cross-section, and, for example, may be formed into recess shapes, curved shapes, or the like prior to forming the S-shaped lateral cross-section profile.

Next, explanation follows regarding operation and advantageous effects of the pressed article manufacturing method of the present disclosure, while explaining the pressed article manufacturing method.

The pressed article manufacturing method includes the first pressing. During the first pressing, the pressed article 26 is manufactured by pressing in which the blank is subjected to drawing using the punch 31, the die 32, and the blank holders 33 as illustrated in FIG. 1A, or manufactured by pressing in which the blank is subjected to bending using the punch 31, the die 32, and the die pad 34, as illustrated in FIG. 1B. Note that other methods may also be employed in the first pressing. Examples thereof include a pad drawing method employing a punch, a die and die pad, and blank holders, a stamping method employing a punch and a die, or a cam bending method employing a punch, and a die and die pad.

Figure 5B:
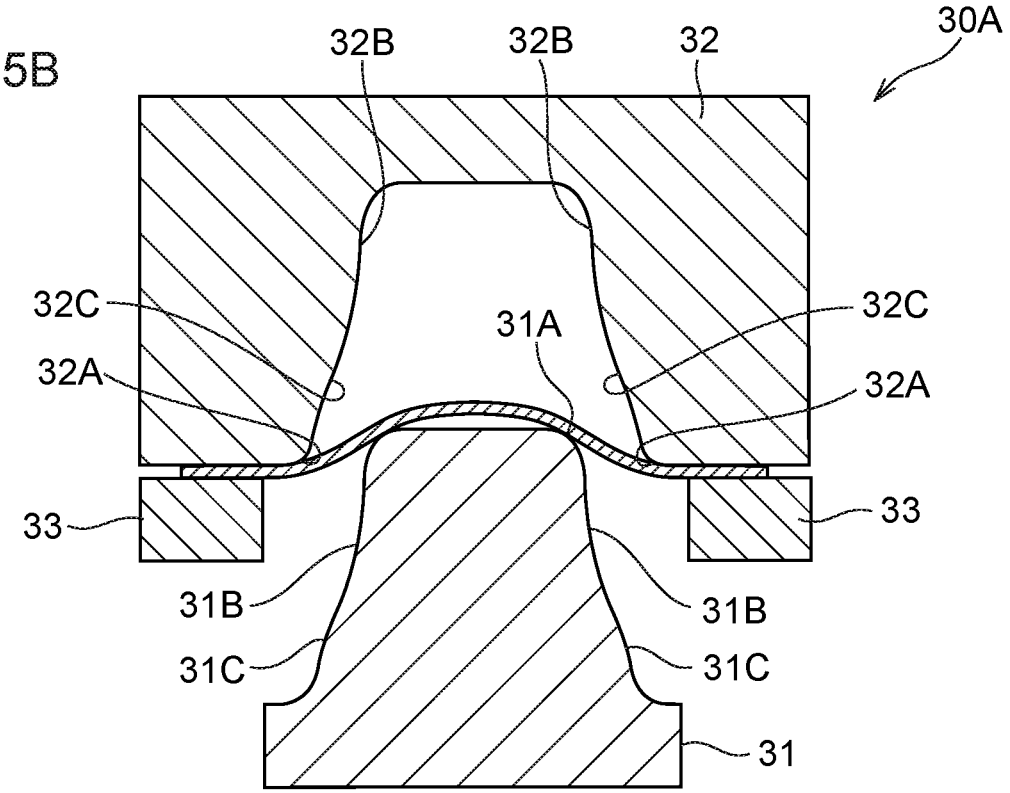
FIG. 5B is a cross-section illustrating a state in which a punch has been moved relatively toward a die side from the state illustrated in FIG. 5A.

Then, to use the example of the first pressing in which the blank is subjected to drawing, illustrated in FIG. 1A, during the first pressing both length direction end portions of the blank are gripped by the pair of blank holders 33 and the die 32. Then, as illustrated in FIG. 5A, the punch 31 is moved toward the upper side so as to approach the die 32. Then, as illustrated in FIG. 5B, the punch 31 is moved further toward the upper side from this state, so as to be inserted into the recess of the die 32. Accordingly, the blank is bent by the corner portions 31A of the punch 31, and bent by the corner portions 32A of the die 32. When this is performed, since the corner portions 31A of the punch 31 and the corner portions 32A of the die 32 are at a separation to each other in the width direction of the press mold 30A, 30B, portions of the blank that will form the base end sides of the vertical walls 23*a*, 23*b* are curved so as to become convex toward radial direction outer sides of the corner portions 31A of the punch 31, and portions of the blank that will form the leading end sides of the vertical walls 23*a*, 23*b* are curved so as to become convex toward radial direction outer sides of the corner portions 32A of the die 32.

The punch 31 is then moved further toward the upper side, and the blank is applied with pressure and gripped by the punch 31 and the die 32, thereby forming the pressed article 20 (see FIG. 1A). Accordingly, the blank that has been bent by the corner portions 31A of the punch 31 (see FIG. 5B) and the corner portions 32A of the die 32 (see FIG. 5B) is bent back to form the vertical walls 23*a*, 23*b*. In this manner, during forming of the vertical walls 23*a*, 23*b*, the blank is subjected to bending, and bend-back, deformation by the punch 31 and the die 32, and moments arise in the vertical walls 23*a*, 23*b* due to stress differences (differences between stress at the front faces (outer side faces) and stress at the back faces (inner side faces) of the vertical walls 23*a*, 23*b*) in the sheet thickness direction of the vertical walls 23*a*, 23*b*.

Specifically, compressive stress acts in the front faces (outer side faces), and tensile stress acts in the back faces (inner side faces) of the base end side portions of the vertical walls 23*a*, 23*b* after forming. Accordingly, due to the difference between the stress at the front faces (outer side faces) and the stress at the back faces (inner side faces) of the vertical walls 23*a*, 23*b*, moment (inward warp moment) that would cause the base end side portions of the respective vertical walls 23*a*, 23*b* to warp so as to curl around toward the inside of the pressed article 20 (in other words, that would cause the vertical walls 23*a*, 23*b* to warp so as to become convex on the front face side) arises in the base end side portions of the vertical walls 23*a*, 23*b* (see the base end side portions of the vertical walls 23*a*, 23*b* illustrated by the dashed lines in FIG. 3).

By contrast, tensile stress acts in the front faces (outer side faces), and compressive stress acts in the back faces (inner side faces) of the leading end side portions of the vertical walls 23*a*, 23*b* after forming. Accordingly, due to the difference between the stress at the front faces (outer side faces) and the stress at the back faces (inner side faces) of the vertical walls 23*a*, 23*b*, moment (outward warp moment) that would cause the leading end side portions of the respective vertical walls 23*a*, 23*b* to warp so as to curl around toward the outside of the pressed article 20 (in other words, that would cause the vertical walls 23*a*, 23*b* to warp so as to become convex on the back face side) arises in the leading end side portions of the vertical walls 23*a*, 23*b* (see the leading end side portions of the vertical walls 23*a*, 23*b* illustrated by the dotted lines in FIG. 3).

Note that the portions of the punch 31 that form the base end side portions of the vertical walls 23*a*, 23*b* (portions on the side of the top plate 21 and the ridge lines 22*a*, 22*b*) are formed with the punch side concave curved face portions 31B, and portions of the punch 31 that form the leading end side portions of the vertical walls 23*a*, 23*b* (portions on the side of the bend lines 24*a*, 24*b* and flanges 25*a*, 25*b*) are formed with the punch side convex curved face portions 31C. Portions of the die 32 that form the base end side portions of the vertical walls 23*a*, 23*b* are formed with the die side convex curved face portions 32B, and portions of the die 32 that form the leading end side portions of the vertical walls 23*a*, 23*b* are formed with the die side concave curved face portions 32C.

Accordingly, as illustrated in FIG. 1A and FIG. 1B, in a state after the first pressing has been completed, and before demolding from the press mold 30A, the base end side portions of the pair of vertical walls 23*a*, 23*b* are applied with pressure and gripped by the punch side concave curved face portions 31B and the die side convex curved face portions 32B in the first warp shapes 23*a*-1, 23*b*-1 that are convex on the back face side of the vertical walls 23*a*, 23*b*. The leading end side portions of the pair of vertical walls 23*a*, 23*b* are applied with pressure and gripped by the punch side convex curved face portions 31C and the die side concave curved face portions 32C in the second warp shapes 23*a*-2, 23*b*-2 that are convex on the front face side of the vertical walls 23*a*, 23*b*. Namely, in the pressed article 20 prior to demolding from the mold, the pair of vertical walls 23*a*, 23*b* are applied with pressure and gripped by the punch 31 and the die 32 so as to adopt an S-shaped lateral cross-section profile.

Accordingly, in the pressed article 20 prior to demolding from the press mold 30A, the base end side portions of the vertical walls 23*a*, 23*b*, which are attempting to warp so as to become convex on the front face side of the vertical walls 23*a*, 23*b* (the outside of the pressed article 20) due to the inward warp moment, are corrected by the first warp shapes 23*a*-1, 23*b*-1 that are warped so as to be convex on the back face side of the vertical walls 23*a*, 23*b*. Moreover, in the pressed article 20, the leading end side portions of the vertical walls 23*a*, 23*b*, which are attempting to warp so as to become convex on the back face side of the vertical walls 23*a*, 23*b* (the inside of the pressed article 20) due to the outward warp moment, are corrected by the second warp shapes 23*a*-2, 23*b*-2 warped so as to be convex on the front face side of the vertical walls 23*a*, 23*b*. Accordingly, the inward warp moment arising in the base end side portions of the vertical walls 23*a*, 23*b* are cancelled out, and the outward warp moment arising in the leading end side portions of the vertical walls 23*a*, 23*b* are cancelled out. As a result, as illustrated in FIG. 4A, when the pressure applied by the punch 31 and the die 32 is removed from the pressed article 20 when demolding from the press mold 30A, the strain difference in the sheet thickness direction is reduced at the base end side portions and the leading end side portions of the vertical walls 23*a*, 23*b*, thereby enabling the occurrence of wall warping in the vertical walls 23*a*, 23*b* (only the vertical wall 23*b* is illustrated in FIG. 4A) to be suppressed.

Figure 4A:
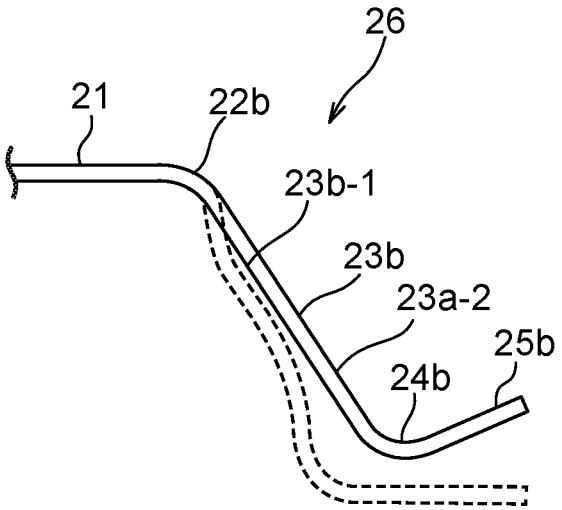
FIG. 4A is an explanatory diagram illustrating the occurrence of vertical wall warping in a pressed article after completion of a first pressing, and after demolding.
Figure 4B:
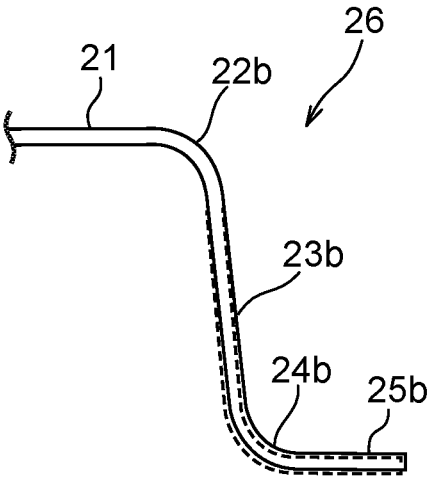
FIG. 4B is an explanatory diagram illustrating the occurrence of vertical wall warping in a pressed article after a second pressing, performed as required, and after demolding.

In cases in which the shape of the pressed article 26 illustrated in FIG. 4A satisfies the shape of the manufactured article, the pressed article 26 may be used as it is as the finished manufactured article. However, in cases in which it is necessary to push the ridge lines 22*a*, 22*b* of the pressed article 26 in further, the pressed article 26 may be restruck after the first pressing so as to form the pressed article into the finished manufactured article. Namely, after the first pressing, a restriking punch and a restriking die may be employed to restrike the ridge lines 22*a*, 22*b* in a second pressing to push the ridge lines 22*a*, 22*b* in further, thereby configuring a finished manufactured article with the desired cross-section profile, illustrated in FIG. 4B (only the vertical wall 23*b* is illustrated in FIG. 4B). Note that in the restriking punch and the restriking die employed when restriking the pressed article 26, faces that form the vertical walls 23*a*, 23*b* are formed with flat plane shapes (straight line shapes as viewed in lateral cross-section).

In this manner, the pressed article manufacturing method of the present disclosure enables the pressed article 26 to be manufactured without forming beads or steps in the vertical walls 23*a*, 23*b*, while spring back (vertical wall warping) of the vertical walls 23*a*, 23*b* is eliminated in practice, when the pressed article 26 has a high tensile strength of, for example, 590 MPa or greater, 780 MPa or greater, or in some cases 980 MPa or greater.

The punch side concave curved face portions 31B, the punch side convex curved face portions 31C, the die side convex curved face portions 32B, and the die side concave curved face portions 32C are formed such that the radii of curvature of both the first warp shapes 23*a*-1, 23*b*-1 and the second warp shapes 23*a*-2, 23*b*-2 of the pressed article 20 are from 10 mm to 800 mm. This thereby enables a good reduction in wall warping in the overall vertical walls 23*a*, 23*b* of the pressed article 26.

Moreover, the respective sums of the cross-section peripheral lengths of the respective first warp shapes 23*a*-1, 23*b*-1 and the cross-section peripheral lengths of the respective second warp shapes 23*a*-2, 23*b*-2 of the pressed article 20 are set to not less than 50% of the cross-section peripheral length of the respective vertical walls 23*a*, 23*b* of the pressed article 26. This thereby enables an effective reduction in wall warping in the overall vertical walls 23*a*, 23*b* of the pressed article 26.

Moreover, the cross-section peripheral lengths of the respective first warp shapes 23*a*-1, 23*b*-1 of the pressed article 20 are set not less than the distance X between the respective corner portions 31A of the punch 31 and the respective corner portions 32A of the die 32 in the width direction of the press mold 30A (30B), and is set equal to or less than ½ the cross-section peripheral length of the vertical walls 23*a*, 23*b*. This thereby enables a reduction in wall warping of the vertical walls 23*a*, 23*b* of the pressed article 26 that can be applied to the bending, drawing, or the like during the first pressing.

EXAMPLE 1

Figure 6A:
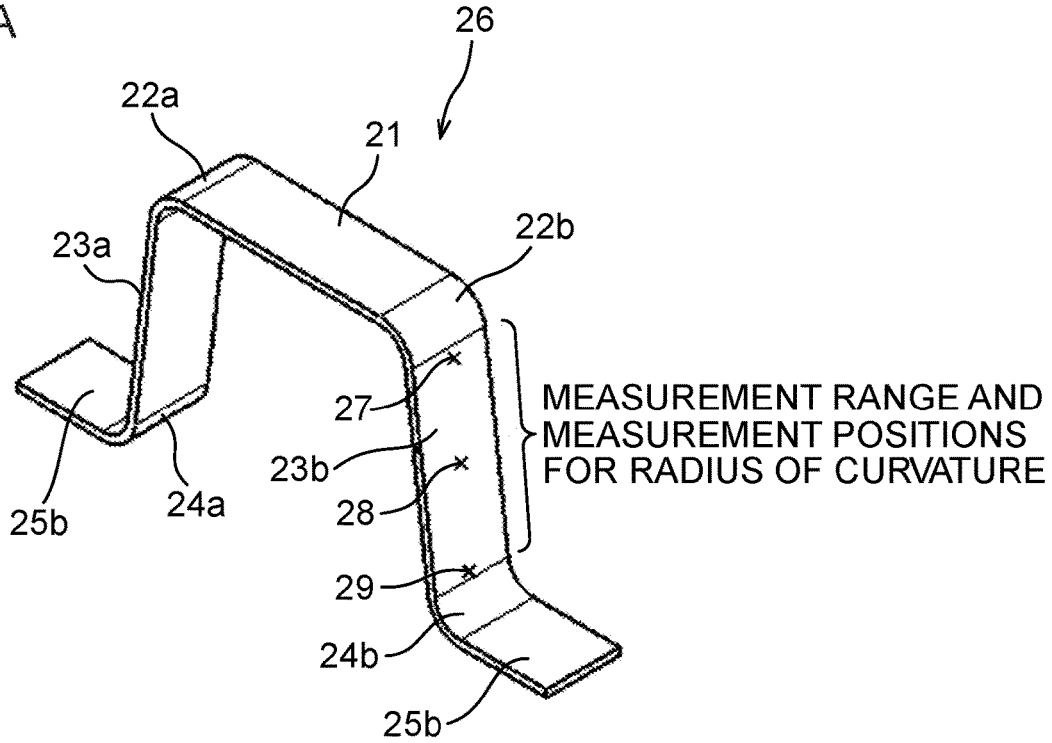
FIG. 6A is an explanatory diagram illustrating a shape of a pressed article manufactured in Example 1.

Example 1 is an example in which the pressed articles 26 were manufactured with hat shaped lateral cross-section profiles. Specifically, the pressed articles 26 were manufactured employing the press mold 30A illustrated in FIG. 1A for the first pressing, using rectangular blanks configured by three classes of steel (length 250 mm, width 27 mm, sheet thickness 1.2 mm; material: DP steel with 1180 MPa grade tensile strength (steel A), DP steel with 980 MPa grade tensile strength (steel B), DP steel with 590 MPa grade tensile strength (steel C)). FIG. 6A is a perspective view illustrating the pressed article 26 after demolding, and FIG. 6B illustrates dimensions of the pressed article 26 after demolding.

Several of the pressed articles 26 (Example 1-(1) to Example 1-(9) in the table in FIG. 7) were manufactured, varying the angles of the vertical walls 23*a*, 23*b* of the pressed article 20 (vertical wall angles, more specifically, the angles of the vertical walls 23*a*, 23*b* with respect to the reference line L) prior to demolding from the press mold 30A, and varying the respective radii of curvature of the first warp shapes 23*a*-1, 23*b*-1 and the second warp shapes 23*a*-2, 23*b*-2, as shown in the table in FIG. 7.

Figure 6B:
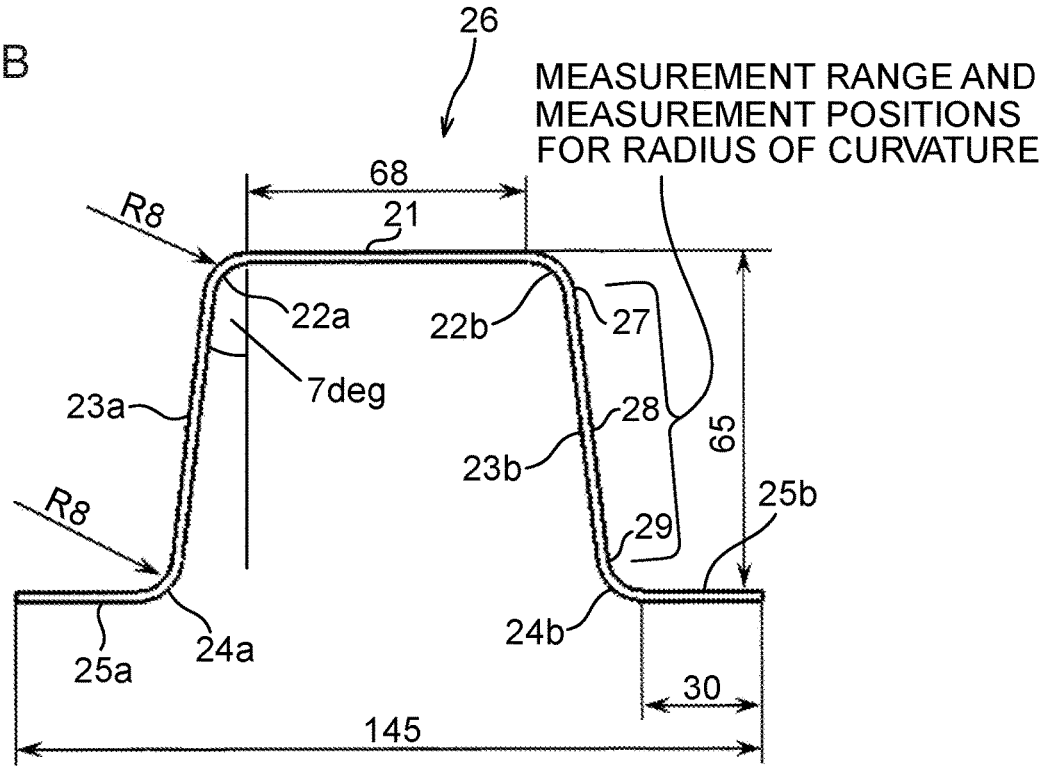
FIG. 6B is an explanatory diagram illustrating dimensions of the pressed article in FIG. 6A.

Then, as illustrated in FIG. 6A and FIG. 6B, the radii of curvature passing through measurement positions 27 to 29 at three respective locations of an upper portion, a central portion, and a lower portion of the vertical wall 23*b* of each demolded pressed article 26 were measured, and spring back of the vertical wall 23*b* (wall warping of the vertical wall 23*b*) was evaluated against comparative examples. Note that in the comparative examples, the punch side concave curved face portions 31B and the punch side convex curved face portions 31C were not provided to the punch 31 of the press mold 30A, and the die side convex curved face portions 32B and the die side concave curved face portions 32C were not provided to the die 32 of the press mold 30A. Namely, in the pressed articles of the comparative examples, the vertical walls 23*a*, 23*b* are formed in substantially straight line shapes prior to demolding from the press mold 30A, and are not formed with the first warp shapes 23*a*-1, 23*b*-1, nor with the second warp shapes 23*a*-2, 23*b*-2.

Figure 8:
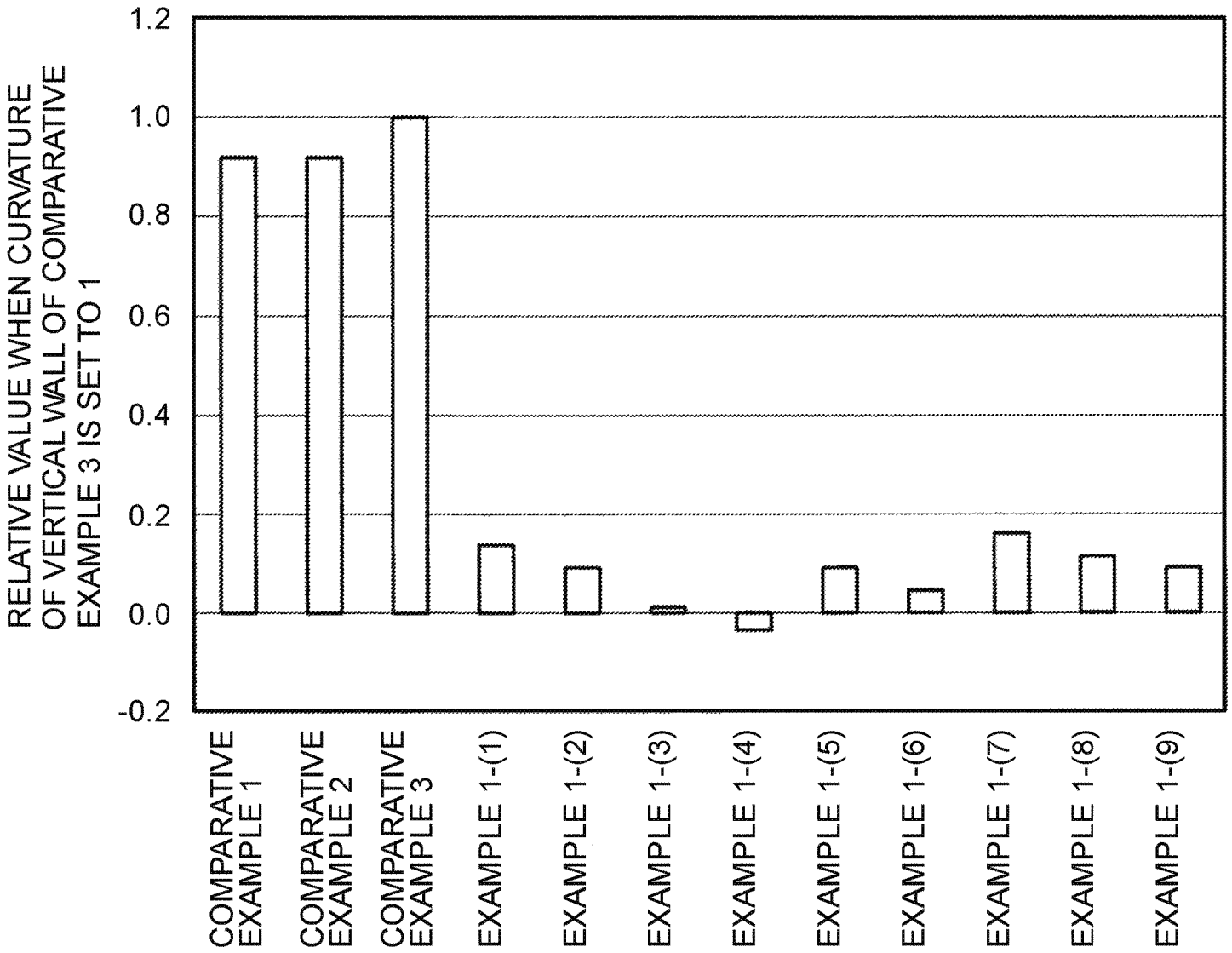
FIG. 8 is a graph summarizing curvature of vertical wall warping in pressed articles of respective comparative examples and Example 1, for respective cases employing DP steel with 980 MPa grade tensile strength as a blank.

FIG. 8 is a graph illustrating relative values of the respective radii of curvature measured for Comparative Examples 1 to 3 and for Examples 1-(1) to 1-(9), for respective cases in which DP steel with 980 MPa grade tensile strength (steel B) was used as the blank. The radius of curvature measured for Comparative Example 3 is set to 1.

Figure 9:
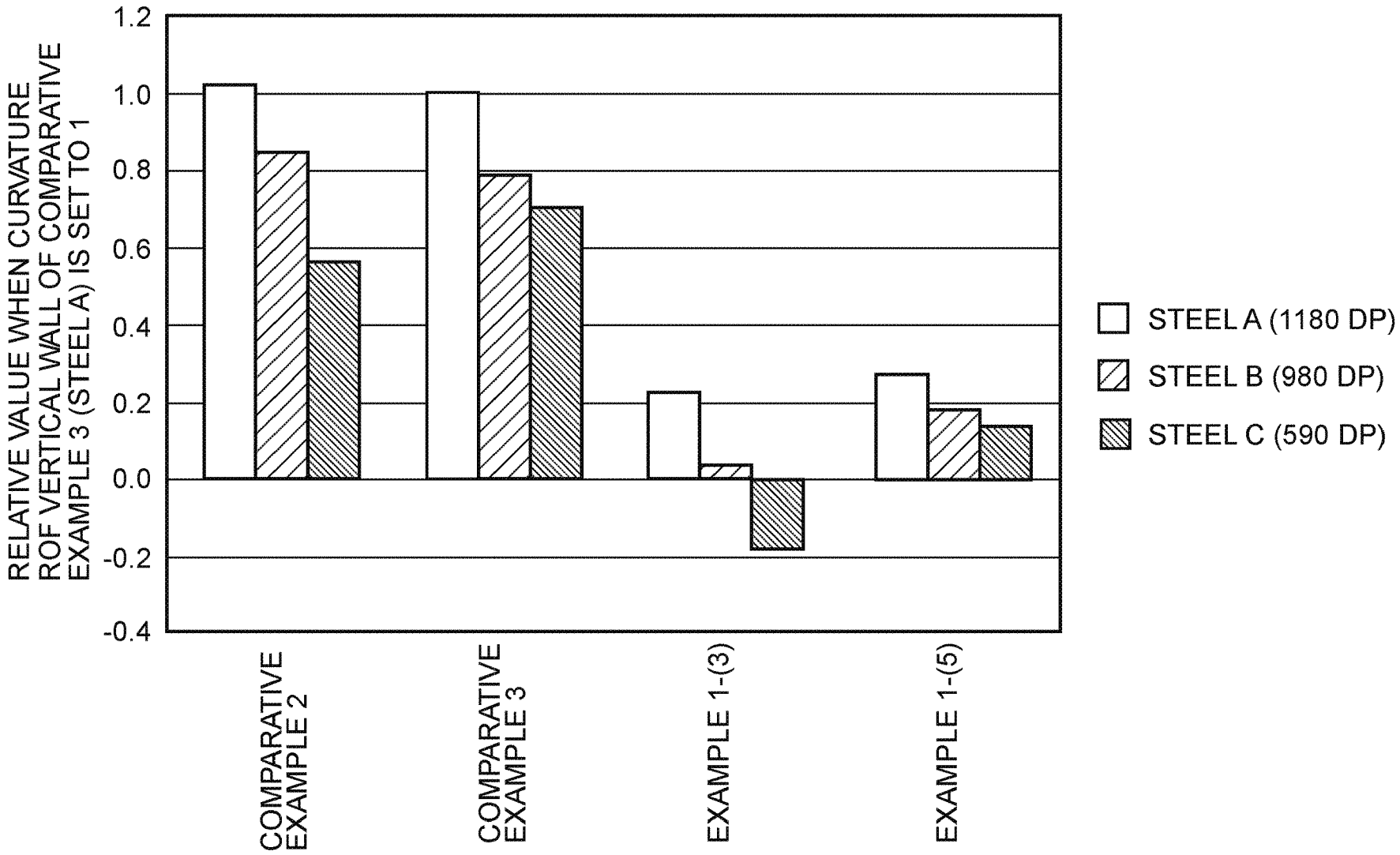
FIG. 9 is a graph summarizing curvature of vertical wall warping in respective pressed articles of comparative examples and Example 1, in cases employing blanks of three classes of tensile strength as a stock material.

FIG. 9 is a graph illustrating relative values of the respective radii of curvature measured for Comparative Examples 2 and 3 and for Examples 1-(3) and 1-(5), for cases in which blanks configured from the three tensile strength classes described above (steel A to steel C) were used as the stock material. The radius of curvature measured for Comparative Example 3 when configured using steel A is set to 1.

As illustrated in the graph of FIG. 8, it can be seen that the curvature of the pressed articles 26 of Examples 1-(1) to 1-(9) was less than approximately ⅕ the curvature of the pressed articles of Comparative Examples 1 to 3. Namely, it can be seen that in the pressed articles 26 of Example 1-(1) to 1-(9), wall warping of the vertical walls 23*a*, 23*b* was greatly suppressed in comparison to Comparative Examples 1 to 3, and was eliminated in practice.

Moreover, as illustrated in the graph of FIG. 9, although there is some difference in curvature between the pressed articles 26 of Examples 1-(3) and 1-(5) depending on the tensile strength of the blank, it can be seen that the curvatures of the pressed articles 26 of Examples 1-(3) and 1-(5) were greatly reduced in comparison to the curvature of the pressed articles of Comparative Examples 2 and 3. Namely, it can be seen that in the pressed articles 26 of Examples 1-(3) and 1-(5), wall warping of the vertical walls 23*a*, 23*b* was greatly suppressed in comparison to Comparative Examples 2 and 3, and was eliminated in practice.

As described above, the pressed article manufacturing method employing the press molds 30A, 30B enables wall warping in the vertical walls 23*a*, 23*b* of the pressed article 26 to be reduced.

EXAMPLE 2

Similarly to in Example 1, in Example 2, pressed articles 26 were manufactured employing the press mold 30A illustrated in FIG. 1A for the first pressing, using rectangular blanks manufactured from three classes of steel. However, in Example 2, the press mold 30A was not provided with the punch side convex curved face portions 31C of the punch 31, and was not provided with the die side concave curved face portions 32C of the die 32. Namely, prior to demolding, in the pressed article 20, only the base end side portions of the vertical walls 23*a*, 23*b* were pressed into the first warp shapes 23*a*-1, 23*b*-1, and the leading end side portions of the vertical walls 23*a*, 23*b* were pressed into substantially straight line shapes as viewed in lateral cross-section. Note that the blanks employed in Example 2 were similar to the blanks employed in Example 1, and the pressed articles 26 of Example 2 had the same dimensions as those of Example 1.

Similarly to in Example 1, several of the pressed articles 26 (Example 2-(1) to Example 2-(4) in the table in FIG. 7) were manufactured, varying the angles (vertical wall angles) of the vertical walls 23*a*, 23*b* of the pressed article 20 prior to demolding, and varying the radii of curvature of the first warp shapes 23*a*-1, 23*b*-1, as shown in the table in FIG. 7.

In Example 2, the radii of curvature passing through measurement positions 27A to 29A (see FIG. 3) at three locations of an upper portion, a central portion, and a lower portion of the base end side portion (a portion corresponding to the first warp shape 23*b*-1 of the pressed article 20) of the vertical wall 23*b* of each demolded pressed article 26 were measured in order to evaluate wall warping of the base end side portion of the vertical wall 23*b* together with the Comparative Examples introduced above.

Figure 10:
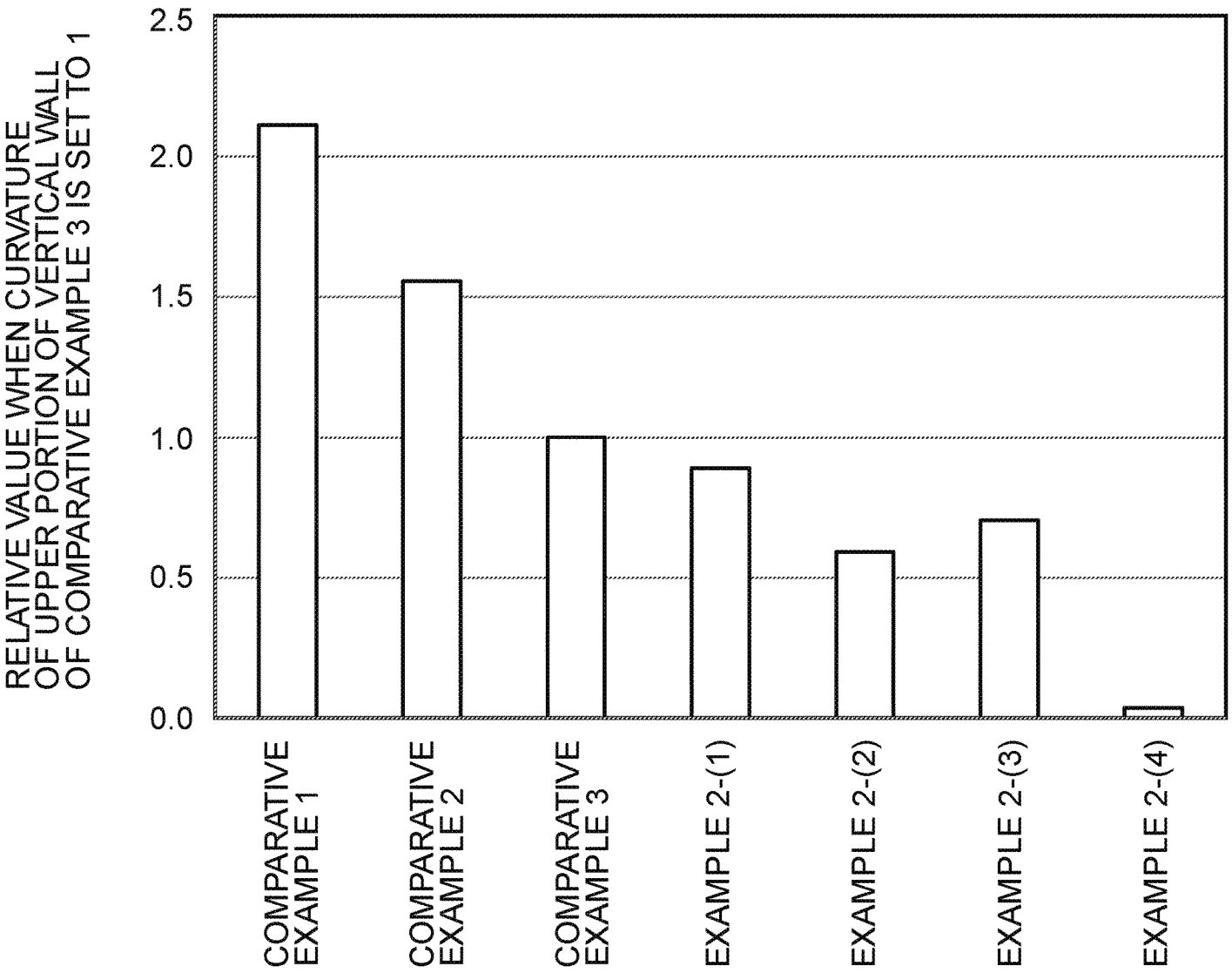
FIG. 10 is a graph summarizing curvature of vertical wall warping in respective pressed articles of comparative examples and Example 2, for respective cases employing DP steel with 980 MPa grade tensile strength as a blank.

FIG. 10 is a graph illustrating relative values for the respective radii of curvature at the measurement positions 27A to 29A measured for Comparative Examples 1 to 3 and for the Examples 2-(1) to 2-(4), for respective cases in which DP steel with 980 MPa grade tensile strength (steel B) was used as the blank. The radii of curvature for Comparative Example 3 at the measurement positions 27A to 29A are set to 1.

Figure 11:
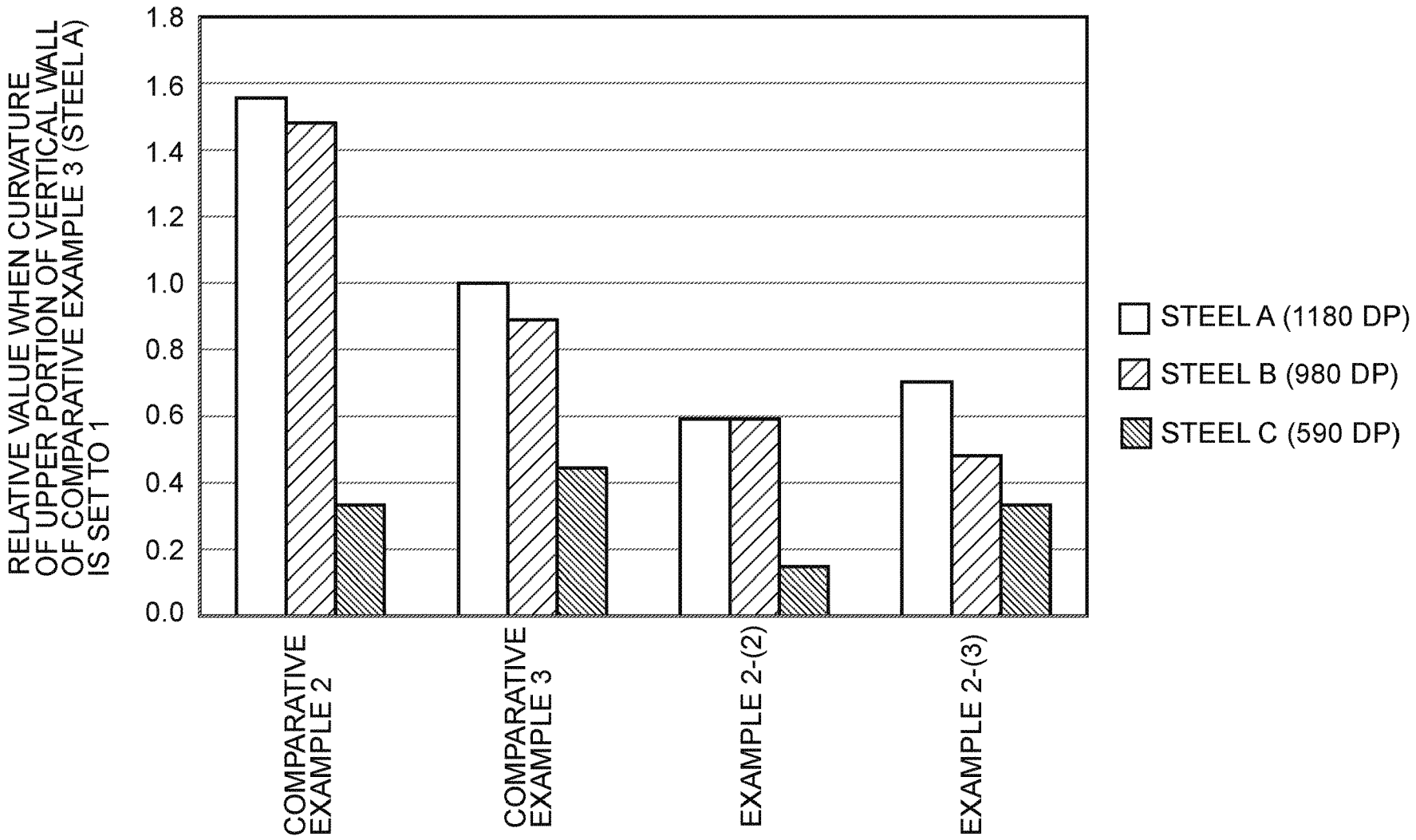
FIG. 11 is a graph summarizing curvature of vertical wall warping in respective pressed articles of comparative examples and Example 2 in cases employing blanks of three classes of tensile strength as a stock material.
Figure 12A:
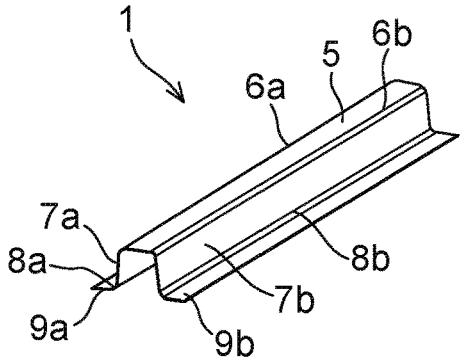
FIG. 12A is an explanatory diagram illustrating a framework member to be disposed at a relevant portion of a body shell.
Figure 12B:
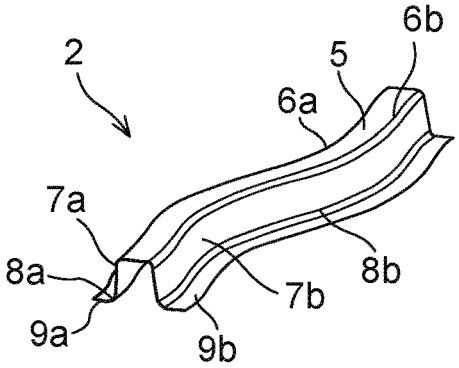
FIG. 12B is an explanatory diagram illustrating another example of a framework member to be disposed at a relevant portion of a body shell.
Figure 12C:
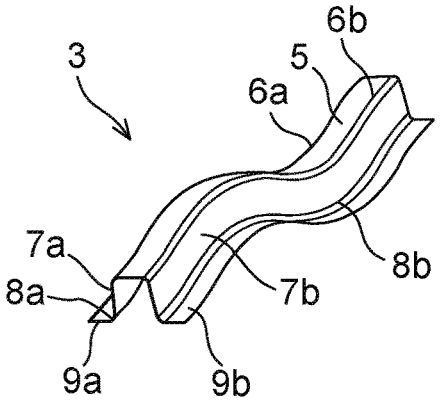
FIG. 12C is an explanatory diagram illustrating another example of a framework member to be disposed at a relevant portion of a body shell.
Figure 12D:
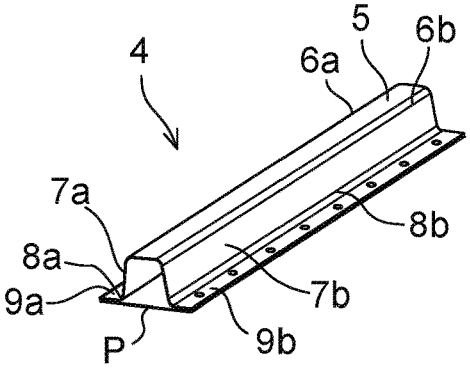
FIG. 12D is an explanatory diagram illustrating another example of a framework member to be disposed at a relevant portion of a body shell.
Figure 13A:
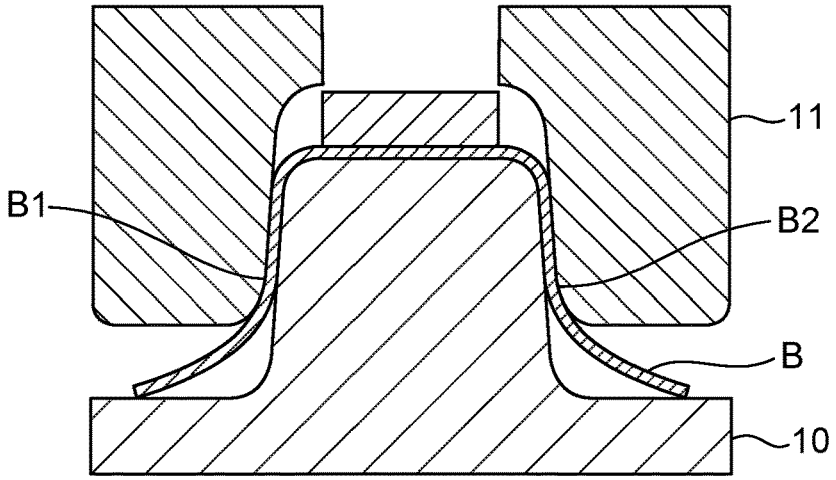
FIG. 13A is a cross-section illustrating pressing of the framework members in FIG. 12A to FIG. 12D.
Figure 13B:
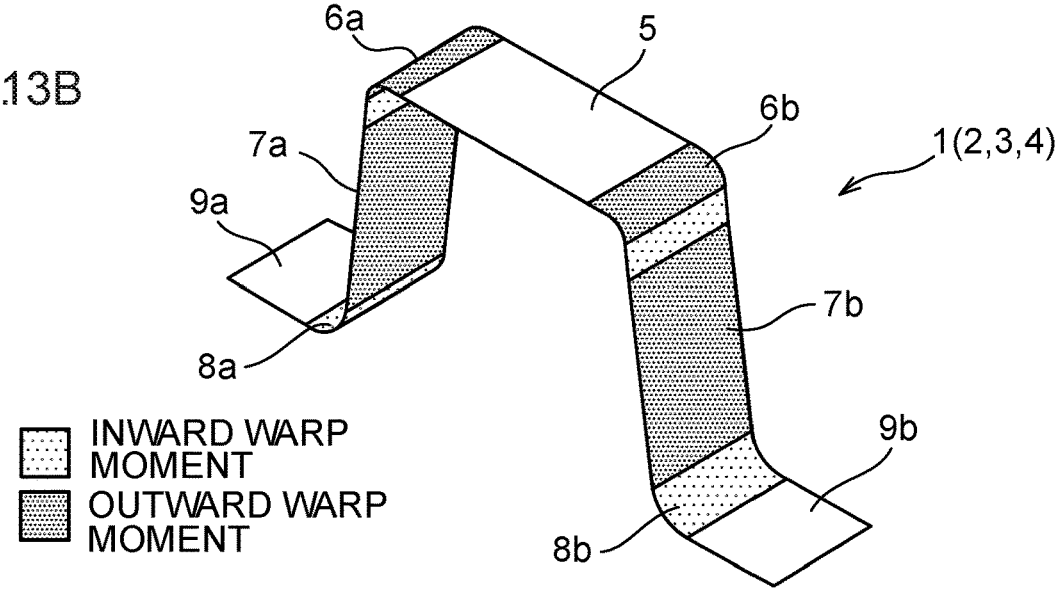
FIG. 13B is a contour diagram illustrating moment distribution in vertical walls of the framework members in FIG. 12A to FIG. 12D.
Figure 13C:
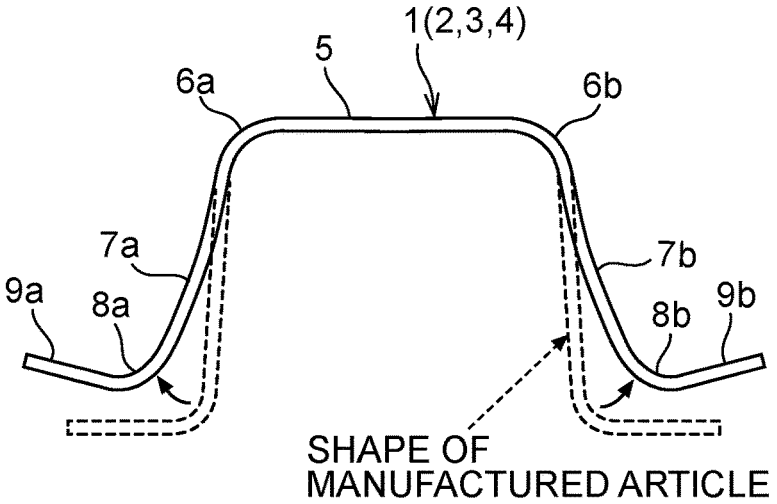
FIG. 13C is a cross-section illustrating vertical wall warping in the framework members in FIG. 12A to FIG. 12D.
Figure 14A:
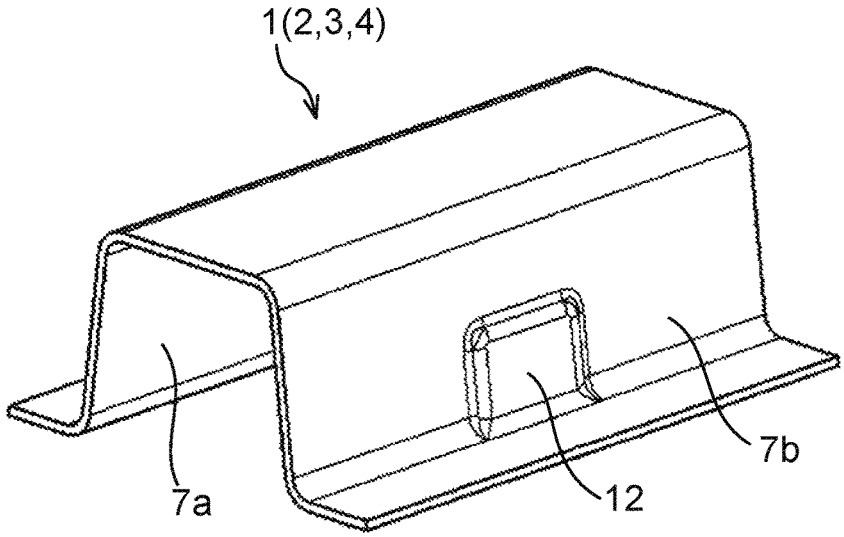
FIG. 14A is an explanatory diagram to explain related technology.
Figure 14B:
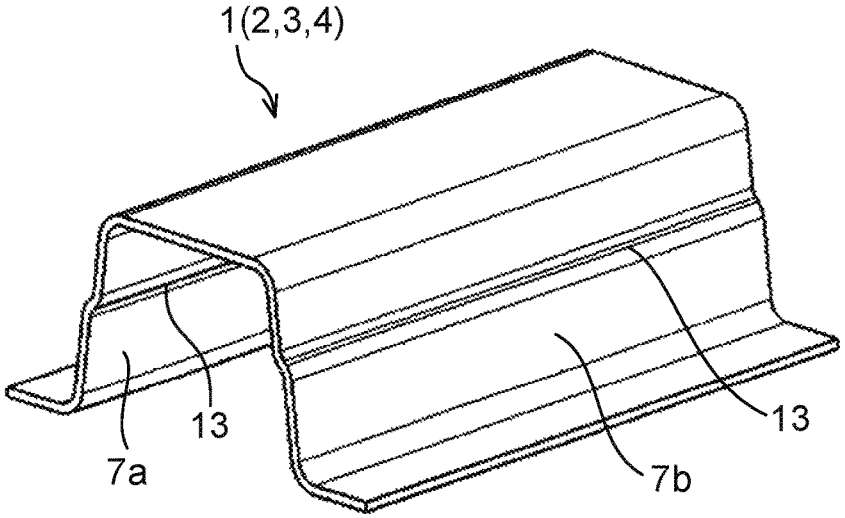
FIG. 14B is an explanatory diagram to explain related technology.
Figure 14C:
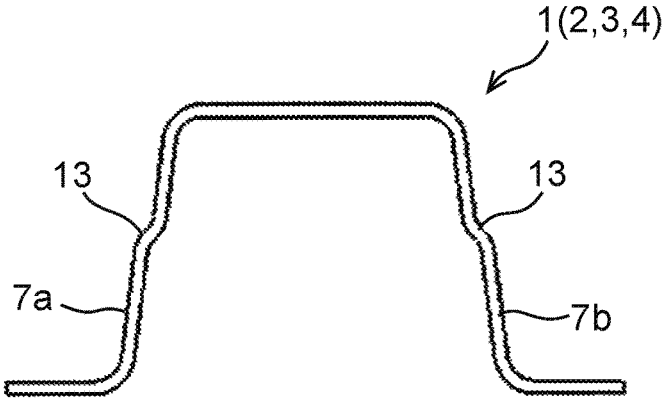
FIG. 14C is an explanatory diagram to explain related technology.
Figure 15:
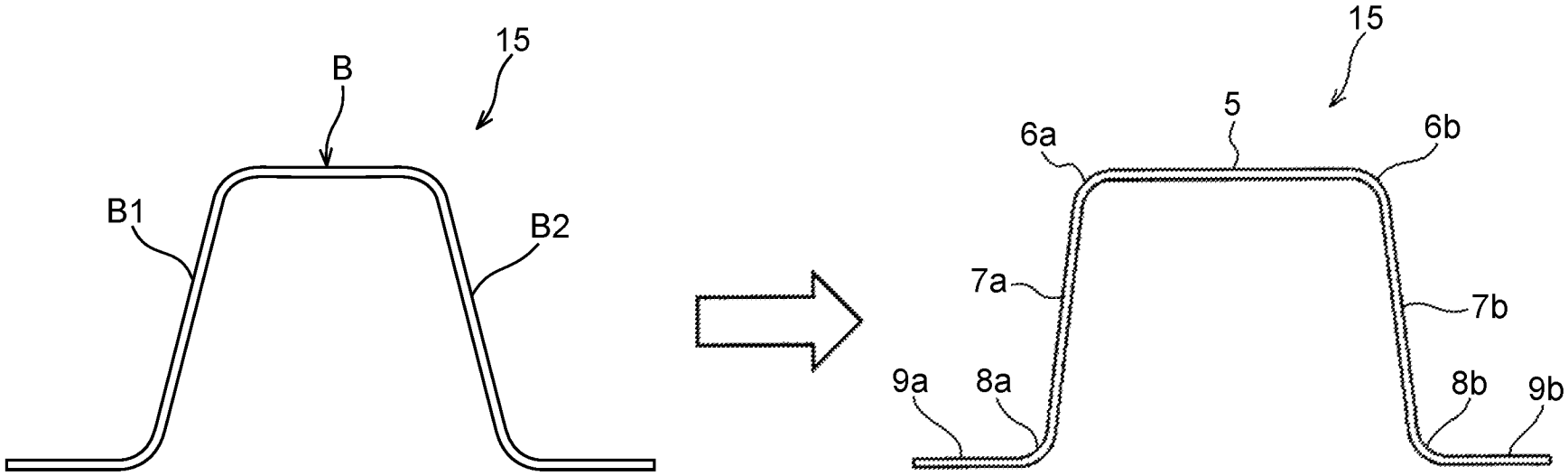
FIG. 15 is an explanatory diagram illustrating technology described in Patent Document 2.

FIG. 11 is a graph illustrating relative values for the respective radii of curvature measured for the measurement positions 27A to 29A in Comparative Examples 2 and 3 and in Examples 2-(2) and 2-(3), for cases in which blanks configured from the three tensile strength classes described above (steel A to steel C) were used as the stock material. The radii of curvature at the measurement positions 27A to 29A for Comparative Example 3 when configured using steel A is set to 1.

As illustrated in the graph of FIG. 10, in Example 2, it can be seen once again that wall warping of the vertical walls 23*a*, 23*b* of the pressed articles 26 of Examples 2-(1) to 2-(4) was suppressed in comparison to Comparative Examples 1 to 3, and was eliminated in practice. Wall warping of the pressed article 26 of Example 2-(4) in particular was greatly suppressed in comparison to Comparative Examples 1 to 3.

As illustrated in the graph of FIG. 11, it can be seen that the curvature of the vertical walls 23*a*, 23*b* of the pressed articles 26 of Examples 2-(2) and 2-(3) was smaller than the curvature of the pressed articles of Comparative Examples 2 and 3 for the blanks of each tensile strength. Namely, it can be seen that in the pressed articles 26 of Examples 2-(2) and 2-(3), wall warping of the vertical walls 23*a*, 23*b* was suppressed in comparison to the Comparative Examples 2 and 3, and was eliminated in practice.

As described above, wall warping of the vertical walls 23*a*, 23*b* at the base end portions of the pressed article 26 can still be reduced even when only the base end side portions of the vertical walls 23*a*, 23*b* of the pressed article 20 are applied with pressure and gripped in the first warp shapes 23*a*-1, 23*b*-1 using the press mold 30A (30B).

The disclosure of Japanese Patent Application No. 2014-131902, filed on Jun. 26, 2014, is incorporated in its entirety by reference herein.

Supplementary Explanation

A pressed article manufacturing method of the present disclosure employs a press mold equipped with a punch and a die to manufacture a pressed article including a first wall, a second wall extending out from an end portion on at least one length direction side of the first wall toward a back face side of the first wall, and a third wall extending out from a leading end portion of the second wall toward a front face side of the second wall. The manufacturing method includes using the punch and the die to apply pressure to and grip a portion on a base end side of the second wall in a first warp shape in which the base end side portion is warped so as to be convex on a back face side of the second wall as viewed in lateral cross-section in a state prior to demolding from the press mold.

The pressed article manufacturing method of the present disclosure preferably further includes using the punch and the die to apply pressure to and grip a portion on a leading end side of the second wall in a second warp shape in which the leading end side portion is warped so as to be convex on the front face side of the second wall as viewed in lateral cross-section in a state prior to demolding from the press mold.

In the pressed article manufacturing method of the present disclosure, preferably radii of curvature of the first warp shape and the second warp shape are from 10 mm to 800 mm as viewed in lateral cross-section in a state prior to demolding from the press mold.

In the pressed article manufacturing method of the present disclosure, preferably the sum of a cross-section peripheral length of the first warp shape and a cross-section peripheral length of the second warp shape is not less than 50% of a cross-section peripheral length of the second wall as viewed in lateral cross-section in a state prior to demolding from the press mold.

In the pressed article manufacturing method of the present disclosure, preferably a cross-section peripheral length of the first warp shape is set so as to be not less than a distance in a width direction of the press mold between a corner portion of the punch and a corner portion of the die, and so as to be not greater than ½ of a cross-section peripheral length of the second wall, as viewed in lateral cross-section in a state prior to demolding from the press mold.

In the pressed article manufacturing method of the present disclosure, preferably the tensile strength of the pressed article is 590 MPa or greater.

A press mold of the present disclosure is a press mold for manufacturing a pressed article including a first wall, a second wall extending out from an end portion on at least one length direction side of the first wall toward a back face side of the first wall, and a third wall extending out from a leading end portion of the second wall toward a front face side of the second wall. The press mold includes a punch and a die that form the pressed article by moving relative to each other in a direction approaching each other. A first pressure application section is formed at the punch and the die, the first pressure application section applying pressure to and gripping a portion on a base end side of the second wall in a first warp shape in which the base end side portion is warped so as to be convex on a back face side of the second wall as viewed in lateral cross-section in a state prior to demolding from the punch and the die.

In the press mold of the present disclosure, preferably a second pressure application section is formed at the punch and the die, the second pressure application section applying pressure to and gripping a portion on a leading end side of the second wall in a second warp shape in which the leading end side portion is warped so as to be convex on the front face side of the second wall as viewed in lateral cross-section in a state prior to demolding from the punch and the die.

In the press mold of the present disclosure, preferably the first pressure application section and the second pressure application section are formed such that radii of curvature of the first warp shape and the second warp shape are from 10 mm to 800 mm as viewed in lateral cross-section in a state prior to demolding from the punch and the die.

In the press mold of the present disclosure, preferably cross-section peripheral lengths of the first pressure application section and the second pressure application section are set such that the sum of a cross-section peripheral length of the first warp shape and a cross-section peripheral length of the second warp shape is not less than 50% of a cross-section peripheral length of the second wall as viewed in lateral cross-section in a state prior to demolding from the punch and the die.

In the press mold of the present disclosure, preferably a length of the first pressure application section is set such that a cross-section peripheral length of the first warp shape is not less than a distance in a width direction of the press mold between a corner portion of the punch and a corner portion of the die, and is not greater than ½ of a cross-section peripheral length of the second wall, as viewed in lateral cross-section in a state prior to demolding from the punch and the die.

In the pressed article manufacturing method of the present disclosure, a first pressing is performed using a first punch and a first die to configure a blank into a molded article with a lateral cross-section configured by a top plate, a ridge line linked to the top plate, a vertical wall linked to the ridge line, a bend line linked to the vertical wall, and a flange linked to the bend line. The vertical wall has an S-shaped lateral cross-section profile including a convex shaped portion that is formed on the ridge line side and that is configured by a line that curves toward the inside of the lateral cross-section profile, and a convex shaped portion that is formed on the bend line side and that is configured by a line that curves toward the outside of the lateral cross-section profile. The molded article is then demolded.

The press mold of the present disclosure is a pressed article manufacturing apparatus including a first punch and a first die that perform a first pressing to form a blank into a molded article with a lateral cross-section configured by a top plate, a ridge line linked to the top plate, a vertical wall linked to the ridge line, a bend line linked to the vertical wall, and a flange linked to the bend line. The vertical wall has an S-shaped lateral cross-section profile including a convex shaped portion that is formed on the ridge line side and that is configured by a line that curves toward the inside of the lateral cross-section profile, and a convex shaped portion that is formed on the bend line side and that is configured by a line that curves toward the outside of the lateral cross-section profile. The first punch has an outer surface profile of the same shape as an inner surface profile of the top plate, the ridge line, and part of the vertical wall respectively, and the first die has an inner surface profile of the same shape as an outer surface profile of the top plate, the ridge line, and part of the vertical wall respectively. The radii of curvature of the convex shaped portion configured by the line that curves toward the inside, and the convex shaped portion configured by the line that curves toward the outside, are both from 10 mm to 800 mm.

The invention claimed is:

1. A pressed article manufacturing method employing a press mold equipped with a punch and a die to manufacture a pressed article including a first wall, a second wall extending out from an end portion on at least one length direction side of the first wall toward a back face side of the first wall, and a third wall extending out from a leading end portion of the second wall toward a front face side of the second wall, the manufacturing method comprising:

using the punch and the die to apply pressure to and grip a portion on a base end side of the second wall in a first curved warp shape in which the base end side portion is warped so as to be convex on a back face side of the second wall as viewed in lateral cross-section in a state prior to demolding from the press mold, and using the punch and the die to apply pressure to and grip a portion on a leading end side of the second wall in a second curved warp shape in which the leading end side portion is warped so as to be convex on the front face side of the second wall as viewed in lateral cross-section in a state prior to demolding from the press mold, wherein the first curved warp shape and the second curved warp shape are provided in this order from the first wall toward the third wall.

2. The pressed article manufacturing method of claim 1, wherein radii of curvature of the first curved warp shape and the second curved warp shape are from 10 mm to 800 mm as viewed in lateral cross-section in a state prior to demolding from the press mold.

3. The pressed article manufacturing method of claim 1, wherein a sum of a cross-section peripheral length of the first curved warp shape and a cross-section peripheral length of the second curved warp shape is not less than 50% of a cross-section peripheral length of the second wall as viewed in lateral cross-section in a state prior to demolding from the press mold.

4. The pressed article manufacturing method of claim 1, wherein a cross-section peripheral length of the first curved warp shape is set so as to be not less than a distance in a width direction of the press mold between a corner portion of the punch and a corner portion of the die, and so as to be not greater than ½ of a cross-section peripheral length of the second wall, as viewed in lateral cross-section in a state prior to demolding from the press mold.

5. The pressed article manufacturing method of claim 1, wherein a tensile strength of the pressed article is 590 MPa or greater.

* * * * *